US009046830B2

(12) United States Patent
Tanaka et al.

(10) Patent No.: US 9,046,830 B2
(45) Date of Patent: Jun. 2, 2015

(54) IMAGE FORMING APPARATUS

(71) Applicants: Shinya Tanaka, Kanagawa (JP); Hirokazu Ishii, Tokyo (JP); Yasunobu Shimizu, Kanagawa (JP); Takehide Mizutani, Kanagawa (JP); Keigo Nakamura, Kanagawa (JP)

(72) Inventors: Shinya Tanaka, Kanagawa (JP); Hirokazu Ishii, Tokyo (JP); Yasunobu Shimizu, Kanagawa (JP); Takehide Mizutani, Kanagawa (JP); Keigo Nakamura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/173,122

(22) Filed: Feb. 5, 2014

(65) Prior Publication Data

US 2014/0248064 A1 Sep. 4, 2014

(30) Foreign Application Priority Data

Mar. 4, 2013 (JP) ..... 2013-041926

(51) Int. Cl.
*G03G 15/16* (2006.01)

(52) U.S. Cl.
CPC ..... *G03G 15/1675* (2013.01); *G03G 15/1605* (2013.01)

(58) Field of Classification Search
None
See application file for complete search history.

(56) References Cited

U.S. PATENT DOCUMENTS

| | | | | |
|---|---|---|---|---|
| 2006/0127125 | A1* | 6/2006 | Mizumoto | 399/103 |
| 2011/0229168 | A1 | 9/2011 | Shiraishi et al. | |
| 2012/0045231 | A1 | 2/2012 | Ogino et al. | |
| 2012/0045237 | A1 | 2/2012 | Aoki et al. | |

(Continued)

FOREIGN PATENT DOCUMENTS

| | | |
|---|---|---|
| EP | 0 856 783 A2 | 8/1998 |
| EP | 2 498 135 A2 | 9/2012 |

(Continued)

OTHER PUBLICATIONS

The Extended European Search Report issued Aug. 29, 2014, in Application No. / Patent No. 14154439.5-1560.

(Continued)

*Primary Examiner* — Clayton E Laballe
*Assistant Examiner* — Jas Sanghera
(74) *Attorney, Agent, or Firm* — Oblon, McClelland, Maier & Neustadt, L.L.P.

(57) ABSTRACT

An image forming apparatus includes a rotatable image bearing member, a nip forming member, and a power source. The rotatable image bearing member bears a toner image on a surface thereof and rotates. The nip forming member contacts the surface of the image bearing member to form a transfer nip therebetween. The power source applies a transfer bias to the transfer nip to transfer the toner image from the image bearing member onto a recording medium interposed in the transfer nip. The transfer bias includes a superimposed transfer bias in which an alternating current (AC) component is superimposed on a direct current (DC) component and a polarity of the superimposed transfer bias changes with time. A phase difference between an AC voltage and an AC current output from the power source is equal to or less than 0.47 cycles.

21 Claims, 12 Drawing Sheets

(56) References Cited

U.S. PATENT DOCUMENTS

| | | | | |
|---|---|---|---|---|
| 2012/0045259 | A1 | 2/2012 | Nakamura et al. | |
| 2012/0230715 | A1 | 9/2012 | Ogino et al. | |
| 2012/0237234 | A1* | 9/2012 | Sugimoto et al. | 399/50 |
| 2012/0237271 | A1 | 9/2012 | Sengoku et al. | |
| 2012/0243892 | A1 | 9/2012 | Nakamura et al. | |
| 2012/0308250 | A1 | 12/2012 | Shimizu et al. | |
| 2012/0315058 | A1 | 12/2012 | Shimizu et al. | |
| 2012/0328314 | A1 | 12/2012 | Sugimoto et al. | |
| 2012/0328315 | A1 | 12/2012 | Takeuchi et al. | |
| 2012/0328320 | A1 | 12/2012 | Fujita et al. | |
| 2012/0328321 | A1 | 12/2012 | Takeuchi et al. | |
| 2013/0004190 | A1 | 1/2013 | Sengoku et al. | |
| 2013/0011155 | A1 | 1/2013 | Ogiyama et al. | |
| 2013/0016989 | A1 | 1/2013 | Fujita et al. | |
| 2013/0064559 | A1 | 3/2013 | Nakamura et al. | |
| 2013/0089363 | A1 | 4/2013 | Mimbu et al. | |
| 2013/0094870 | A1 | 4/2013 | Shimizu et al. | |
| 2013/0121714 | A1 | 5/2013 | Tanaka et al. | |
| 2013/0136468 | A1 | 5/2013 | Shimizu et al. | |
| 2013/0136477 | A1 | 5/2013 | Ogiyama et al. | |
| 2013/0142531 | A1 | 6/2013 | Sugimoto et al. | |
| 2013/0148993 | A1 | 6/2013 | Aoki et al. | |
| 2013/0164011 | A1 | 6/2013 | Nakamura et al. | |
| 2013/0177329 | A1 | 7/2013 | Tanaka et al. | |
| 2013/0195483 | A1 | 8/2013 | Shimizu et al. | |
| 2013/0216281 | A1 | 8/2013 | Suzuki et al. | |
| 2013/0236201 | A1 | 9/2013 | Mizutani et al. | |
| 2013/0294791 | A1 | 11/2013 | Nakamura | |
| 2013/0308968 | A1 | 11/2013 | Tanaka et al. | |

FOREIGN PATENT DOCUMENTS

| | | | |
|---|---|---|---|
| EP | 2 500 782 | A2 | 9/2012 |
| JP | 9-146381 | | 6/1997 |
| JP | 2006-267486 | | 10/2006 |
| JP | 2008-096533 | | 4/2008 |
| JP | 2012-042827 | | 3/2012 |
| JP | 2012-042832 | | 3/2012 |
| JP | 2012-063746 | | 3/2012 |

OTHER PUBLICATIONS

U.S. Appl. No. 14/005,770, filed Mar. 16, 2012.
U.S. Appl. No. 14/022,512, filed Sep. 10, 2013.
U.S. Appl. No. 13/918,088, filed Jun. 14, 2013.

* cited by examiner

FIG. 18

| | PHASE DIFFERENCE | WHITE SPOTS | IMAGE DENSITY |
|---|---|---|---|
| COMPARATIVE EXAMPLE 1 | 0.49 | POOR | EXCELLENT |
| COMPARATIVE EXAMPLE 2 | 0.48 | POOR | EXCELLENT |
| EMBODIMENT 1 | 0.47 | GOOD | EXCELLENT |
| EMBODIMENT 2 | 0.46 | GOOD | EXCELLENT |
| EMBODIMENT 3 | 0.44 | EXCELLENT | EXCELLENT |
| EMBODIMENT 4 | 0.42 | EXCELLENT | EXCELLENT |
| EMBODIMENT 5 | 0.40 | EXCELLENT | EXCELLENT |
| EMBODIMENT 6 | 0.38 | EXCELLENT | EXCELLENT |
| EMBODIMENT 7 | 0.37 | EXCELLENT | GOOD |
| COMPARATIVE EXAMPLE 3 | 0.36 | EXCELLENT | FAIR |
| COMPARATIVE EXAMPLE 4 | 0.34 | EXCELLENT | POOR |

IMAGE FORMING APPARATUS

CROSS-REFERENCE TO RELATED APPLICATIONS

This patent application is based on and claims priority pursuant to 35 U.S.C. §119 to Japanese Patent Application No. 2013-041926, filed on Mar. 4, 2013, in the Japan Patent Office, the entire disclosure of which is hereby incorporated by reference herein.

BACKGROUND

1. Technical Field

Exemplary aspects of the present disclosure generally relates to a transfer device and an image forming apparatus, such as a copier, a facsimile machine, a printer, or a multi-functional system including a combination thereof, and more particularly to a transfer device to transfer an unfixed toner image onto a recording medium by applying a transfer bias, and an image forming apparatus including the transfer device.

2. Description of the Related Art

In recent years, a variety of recording media such as paper having a luxurious, leather-like texture and Japanese paper known as "Washi" have come on the market. Such recording media have a coarse surface acquired through embossing to produce that luxurious impression. When transferring the toner image onto such recording media, toner does not transfer well to recessed portions of the surface as compared with projecting portions on the surface. As a result, the toner image is not transferred well to the recessed portions of the surface, and an image density at the recessed portions is lower than the image density at the projecting portions, which appears as a pattern of light and dark patches on a resulting output image.

In order to prevent inadequate transfer of toner in the recessed portions of the recording medium surface, in one approach, a transfer bias (hereinafter referred to as a superimposed transfer bias), in which an alternating current (AC) component is superimposed on a DC component and the polarity changes with time, is used. Such a configuration is proposed in JP-2012-63746-A. In this configuration, the superimposed transfer bias causes the toner to move back-and-forth between the recessed portions of the surface of the recording medium and the image bearing member, thereby moving the toner to the recessed portions.

Although advantageous, when using the superimposed transfer bias as a transfer bias to transfer the toner image from the image bearing member to the recording medium, improper transfer of toner such as white spots also known as dropouts occurs easily in the image on the recording medium. The white spots are generated when electrical discharge occurs in a transfer nip at which the image bearing member and the intermediate transfer belt meet and press against each other and the toner at the place where the electrical discharge occurs loses its charge. As a result, the toner fails to be transferred to the recording medium.

In view of the above, if the electrical discharge is prevented by reducing the maximum potential difference between the image bearing member and the recording medium in the transfer nip, formation of the white spots may be suppressed.

However, the purpose of applying the superimposed transfer bias as a transfer bias lies in moving the toner back-and-forth between the image bearing member and the recording medium in the transfer nip so that the toner is reliably transferred to recessed portions of the recording medium. In order to achieve such movement of toner, a significant amount of voltage is required as a peak-to-peak voltage of the superimposed transfer bias. For this reason, the peak-to-peak voltage of the superimposed transfer bias cannot be reduced too much, and hence the maximum potential difference between the image bearing member and the recording medium in the transfer nip cannot be reduced adequately. Consequently, white spots are easily generated, when using the superimposed transfer bias.

The similar problem occurs when an image is formed on a recording medium having a relatively smooth surface using the superimposed transfer bias as a transfer bias.

SUMMARY

In view of the foregoing, in an aspect of this disclosure, there is provided an improved image forming apparatus including a rotatable image bearing member, a nip forming member, and a power source. The rotatable image bearing member bears a toner image on a surface thereof and rotates. The nip forming member contacts the surface of the image bearing member to form a transfer nip therebetween. The power source applies a transfer bias to the transfer nip to transfer the toner image from the image bearing member onto a recording medium interposed in the transfer nip. The transfer bias includes a superimposed transfer bias in which an alternating current (AC) component is superimposed on a direct current (DC) component and a polarity of the superimposed transfer bias changes with time. A phase difference between an AC voltage and an AC current output from the power source is equal to or less than 0.47 cycles.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein:

FIG. 18 is a table showing results of an experiment 1; and

DETAILED DESCRIPTION

Figure 1:
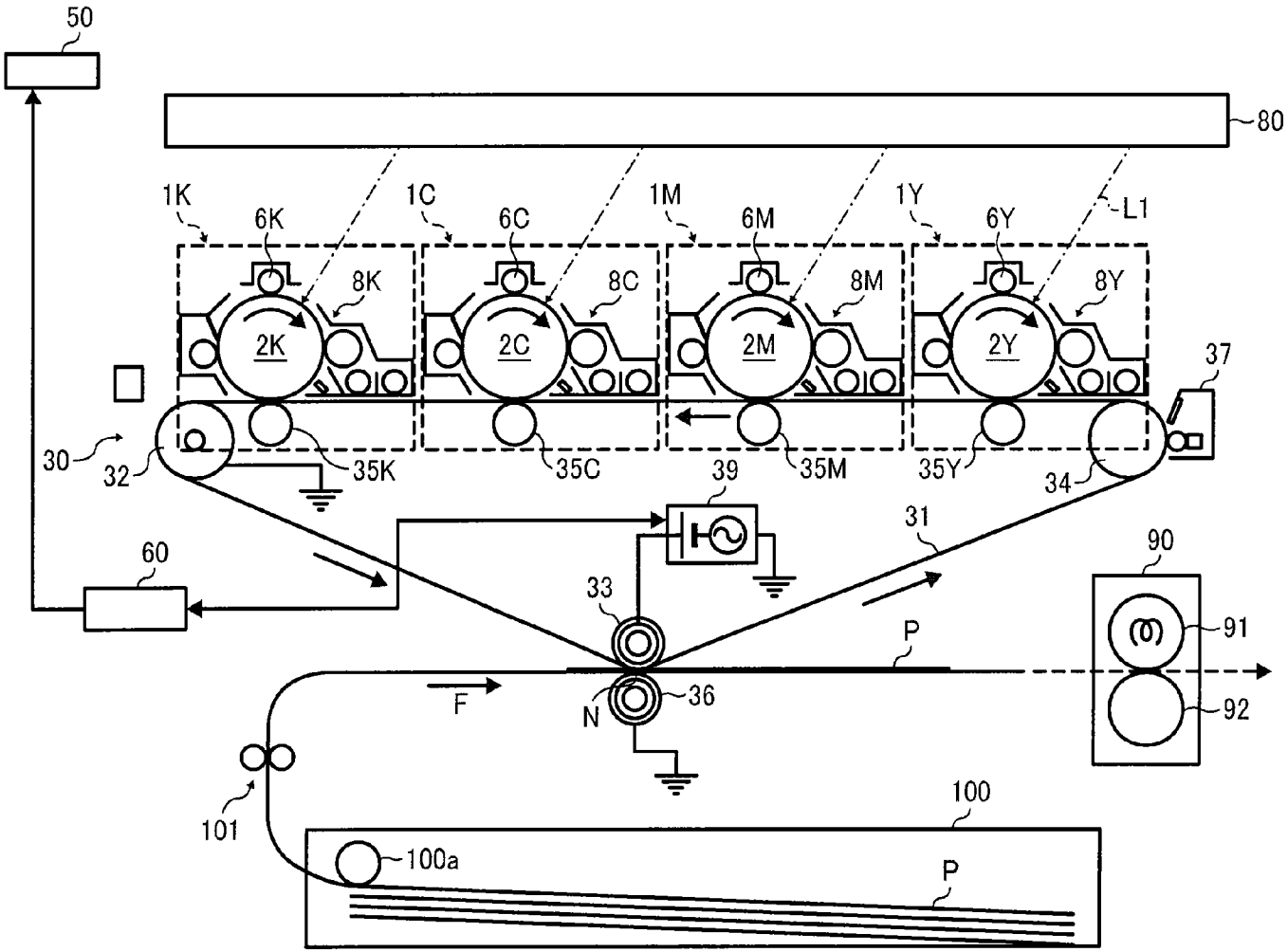
FIG. 1 is a schematic diagram illustrating a printer as an example of an image forming apparatus.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, exemplary embodiments of the present patent application are described.

With reference to FIG. 1, a description is provided of a color printer using an electrophotographic method as an example of an image forming apparatus according to an illustrative embodiment of the present disclosure. FIG. 1 is a schematic diagram illustrating the image forming apparatus.

As illustrated in FIG. 1, the image forming apparatus includes four image forming units 1Y, 1M, 1C, and 1K for forming toner images, one for each of the colors yellow, magenta, cyan, and black, respectively, a transfer unit 30, an optical writing unit 80, a fixing device 90, a sheet cassette 100, a pair of registration rollers 101, and a controller 60. The controller 60 may be a processor and a control circuitry. It is to be noted that the suffixes Y, M, C, and K denote colors yellow, magenta, cyan, and black, respectively. To simplify the description, these suffixes Y, M, C, and K indicating colors are omitted herein, unless otherwise specified.

The image forming units 1Y, 1M, 1C, and 1K all have the same configuration as all the others, differing only in the color of toner employed. Thus, a description is provided of the image forming unit 1K for forming a toner image of black as a representative example of the image forming units. The image forming units 1Y, 1M, 1C, and 1K are replaced upon reaching their product life cycles.

Figure 2:
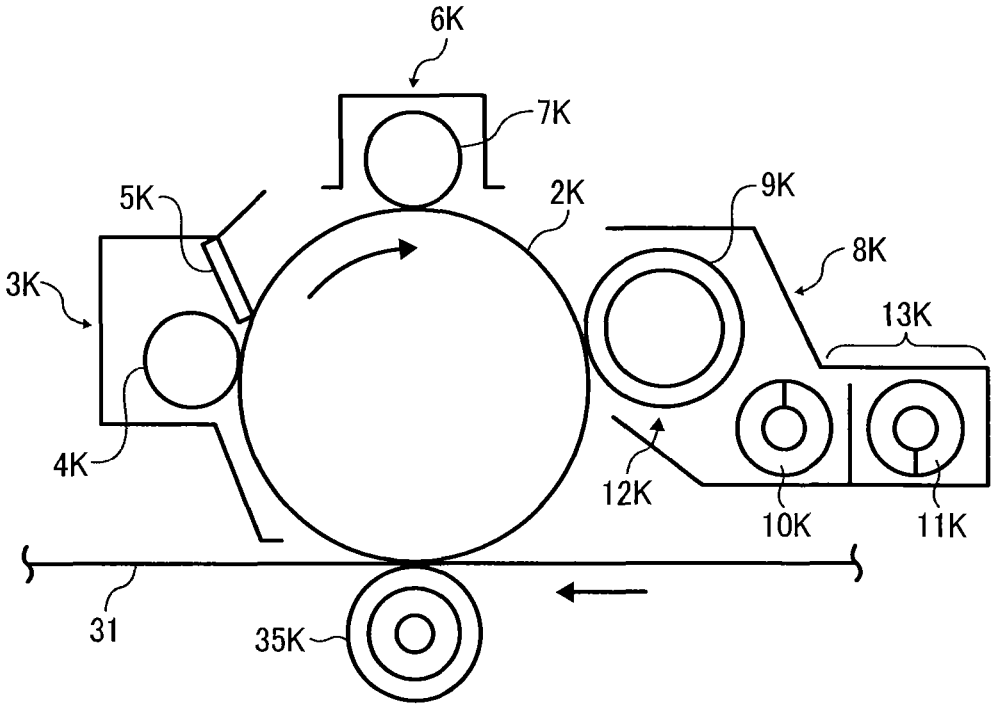
FIG. 2 is a schematic diagram illustrating an image forming unit for black as an example of image forming units employed in the image forming apparatus of FIG. 1.

With reference to FIG. 2, a description is provided of the image forming unit 1K as an example of the image forming units. FIG. 2 is a schematic diagram illustrating the image forming unit 1K. As illustrated in FIG. 2, the image forming unit 1K for forming a black toner image includes a drum-shaped photosensitive drum 2K (hereinafter referred to as photosensitive drum) serving as a latent image bearing member, a charging device 6K, a developing device 8K, a drum cleaner 3K, a charge remover, and so forth. These devices are held in a common holder so that they are detachably installable and replaced at the same time. Similar to the image forming unit 1K, the image forming units 1Y, 1M, and 1C include photosensitive drums 2Y, 2M, and 2C, respectively. The photosensitive drums 2Y, 2M, and 2C are surrounded by charging devices 6Y, 6M, and 6C, developing devices 8Y, 8M, and 8C, drum cleaning devices 3Y, 3M, and 3C, respectively.

The photosensitive drum 2K is comprised of a drum-shaped base on which an organic photosensitive layer is disposed. The photosensitive drum 2K is rotated in a clockwise direction by a driving device. The charging device 6K includes a charging roller 7K supplied with a charging bias. The charging roller 7K contacts or approaches the photosensitive drum 2K to generate electric discharge therebetween, thereby charging uniformly the surface of the photosensitive drum 2K. According to the present illustrative embodiment, the photosensitive drum 2K is uniformly charged with a negative polarity which is the same polarity as the normal charge polarity of the toner. More specifically, the photosensitive drum 2K is charged uniformly at approximately −650 V.

According to the present illustrative embodiment, an alternating current (AC) voltage superimposed on a direct current (DC) voltage (or which may be treated as a DC current) is employed as the charging bias. The charging roller 7K comprises a metal cored bar coated with a conductive elastic layer made of a conductive elastic material. According to the present illustrative embodiment, the photosensitive drum 2K is charged by a charger, i.e., the charging roller 7K contacting the photosensitive drum 2K or disposed near the photosensitive drum 2K. Alternatively, a corona charger may be employed.

The uniformly charged surface of the photosensitive drum 2K is scanned by a light beam projected from the optical writing unit 80, thereby forming an electrostatic latent image for black on the surface of the photosensitive drum 2K. The potential of the electrostatic latent image for black is approximately −100 V. The electrostatic latent image for the color black on the photosensitive drum 2K is developed with black toner by the developing device 8K. Accordingly, a visible image, also known as a toner image, is formed. Here, a black-color toner image is formed. As will be described later in detail, the toner image is transferred primarily onto an intermediate transfer belt 31 serving as an image bearing member.

The drum cleaner 3K removes residual toner remaining on the surface of the photosensitive drum 2K after a primary transfer process, that is, after the photosensitive drum 3K passes through a primary transfer nip between the intermediate transfer belt 31 and the photosensitive drum 2K. The drum cleaner 3K includes a brush roller 4K which is rotated and a cleaning blade 5K. The cleaning blade 5K is cantilevered, that is, one end thereof is fixed to the housing of the drum cleaner 3K, and its free end contacts the surface of the photosensitive drum 2K. The brush roller 4K rotates and brushes off the residual toner from the surface of the photosensitive drum 2K while the cleaning blade 5K removes the residual toner by scraping.

It is to be noted that the cantilevered end of the cleaning blade 5K is positioned downstream from its free end contacting the photosensitive drum 2K in the direction of rotation of the photosensitive drum 2K so that the free end of the cleaning blade 5K faces or becomes counter to the direction of rotation.

The charge remover removes residual charge remaining on the photosensitive drum 2K after the surface thereof is cleaned by the drum cleaner 3K. The surface of the photosensitive drum 2K is initialized in preparation for the subsequent imaging cycle.

The developing device 8K includes a developing section 12K and a developer conveyer 13K. The developing section 12K includes a developing roller 9K inside thereof.

The developer conveyer 13K mixes a developing agent for the color black while transporting the developing agent. The developer conveyer 13K includes a first chamber equipped with a first screw 10K and a second chamber equipped with a second screw 11K. The first screw 10K and the second screw 11K are each constituted of a rotatable shaft and helical flighting wrapped around the circumferential surface of the shaft. Each end of the shaft of the first screw 10K and the second screw 11K in the axial direction is rotatably held by shaft bearings.

The first chamber with the first screw 10K and the second chamber with the second screw 11K are separated by a wall, but each end of the wall in the axial direction of the screw shaft has a connecting hole through which the first chamber and the second chamber communicate. The first screw 10K mixes the developing agent by rotating the helical flighting and carries the developing agent from the distal end to the proximal end of the screw in the direction perpendicular to the surface of the recording medium while rotating. The first screw 10K is disposed parallel to and facing the developing roller 9K. The developing agent is delivered along the axial (shaft) direction of the developing roller 9K. The first screw 10K supplies the developing agent to the surface of the developing roller 9K along the direction of the shaft line of the developing roller 9K.

The developing agent transported near the proximal end of the first screw 10K passes through the connecting hole in the wall near the proximal side and enters the second chamber. Subsequently, the developing agent is carried by the helical flighting of the second screw 11K. As the second screw 11K rotates, the developing agent is delivered from the proximal end to the distal end in FIG. 2 while being mixed in the direction of rotation.

In the second chamber, a toner density detector for detecting the density of toner in the developing agent is disposed substantially at the bottom of a casing of the chamber. As the toner density detector, a magnetic permeability detector is employed. Because the magnetic permeability of the two-component developing agent consisting of toner particles and magnetic carriers is correlated with the toner density of the black toner, it means that the magnetic permeability detector is detecting the density of the toner.

Although not illustrated, the image forming apparatus includes toner supply devices to independently supply toner of yellow, magenta, cyan, and black to the second chamber of the respective developing device. The controller 60 of the image forming apparatus includes a Random Access Memory (RAM) to store a target output voltage Vtref for each output voltage provided by the toner density detectors for yellow, magenta, cyan, and black. If the difference between each output voltage provided by the toner detectors and Vtref for each color exceeds a predetermined value, the toner supply devices are activated. Accordingly, the respective color of toner is supplied to the second chamber of the developing device.

The developing roller 9K in the developing section 12K faces the first screw 10K as well as the photosensitive drum 2K through an opening formed in the casing of the developing device 8K. The developing roller 9K comprises a cylindrical developing sleeve made of a non-magnetic pipe which is rotated, and a magnetic roller disposed inside the developing sleeve. The magnetic roller is fixed so as not to rotate together with the developing sleeve. The developing agent supplied from the first screw 10K is borne on the surface of the developing sleeve due to the magnetic force of the magnetic roller. As the developing sleeve rotates, the developing agent is transported to a developing area facing the photosensitive drum 2K.

The developing sleeve is supplied with a developing bias having the same polarity as toner. The developing bias is greater than the potential of the electrostatic latent image on the photosensitive drum 2K, but smaller than the electrical potential of the uniformly charged photosensitive drum 2K. With this configuration, a developing potential that causes the toner on the developing sleeve to move electrostatically to the electrostatic latent image on the photosensitive drum 2K acts between the developing sleeve and the electrostatic latent image on the photosensitive drum 2K. A non-developing potential acts between the developing sleeve and the non-image formation areas of the photosensitive drum 2K, causing the toner on the developing sleeve to move to the sleeve surface. Due to the developing potential and the non-developing potential, the toner on the developing sleeve moves selectively to the electrostatic latent image formed on the photosensitive drum 2K, thereby forming a visible image, known as a toner image, here, a black toner image.

In FIG. 1, similar to the image forming unit 1K, in the image forming units 1Y, 1M, and 1C, toner images of yellow, magenta, and cyan are formed on the photosensitive drums 2Y, 2M, and 2C, respectively in the same manner.

The optical writing unit 80 as a latent image writer for writing a latent image on the photosensitive drums 2Y, 2M, 2C, and 2K is disposed above the image forming units 1Y, 1M, 1C, and 1K. Based on image information provided by external devices such as a personal computer (PC), the optical writing unit 80 illuminates the photosensitive drums 2Y, 2M, 2C, and 2K with a light beam projected from a light source, for example, a laser diode of the optical writing unit 80. Accordingly, electrostatic latent images for the colors yellow, magenta, cyan, and black are formed on the photosensitive drums 2Y, 2M, 2C, and 2K, respectively. More specifically, the potential of the portion of the charged surface of the photosensitive drum 2 illuminated with the light beam is attenuated. The potential of the illuminated portion of the photosensitive drum 2 with the light beam is less than the potential of the other area, that is, a background portion (non-image formation area), thereby forming an electrostatic latent image on the surface of the photosensitive drum 2.

The optical writing unit 80 includes a polygon mirror, a plurality of optical lenses, and mirrors. The light beam L1 projected from the laser diode serving as a light source is deflected in a main scanning direction by the polygon mirror rotated by a polygon motor. The deflected light, then, strikes the plurality of optical lenses and mirrors, thereby scanning each photosensitive drum 2. Alternatively, the optical writing unit 80 may employ a light source using an LED array including a plurality of LEDs that projects light.

Referring back to FIG. 1, a description is provided of the transfer unit 30. The transfer unit 30 is disposed below the image forming units 1Y, 1M, 1C, and 1K. The transfer unit 30 includes the intermediate transfer belt 31 as an image bearing member formed into an endless loop and entrained about a plurality of rollers, thereby being moved endlessly in the counterclockwise direction indicated by an arrow. The transfer unit 30 also includes also a drive roller 32, a cleaning backup roller 34, a nip forming roller 36 serving as a nip formation device, an secondary-transfer back surface roller 33, a belt cleaning device 37, four primary transfer rollers 35Y, 35M, 35C, and 35K as transfer devices, and so forth.

The intermediate transfer belt 31 is entrained around and stretched taut between the plurality of rollers, i.e., the drive roller 32, the secondary-transfer back surface roller 33, the cleaning backup roller 34, and the primary transfer rollers 35Y, 35M, 35C, and 35K (which may be collectively referred to as the primary transfer rollers 35, unless otherwise specified.) According to the present illustrative embodiment, the drive roller 32 is rotated in the counterclockwise direction by a driving device such as a motor, and rotation of the drive roller 32 enables the intermediate transfer belt 31 to rotate in the counterclockwise direction in FIG. 1.

The intermediate transfer belt 31 is interposed between the photosensitive drums 2Y, 2M, 2C, and 2K, and the primary transfer rollers 35Y, 35M, 35C, and 35K. Accordingly, primary transfer nips are formed between the front surface (image bearing surface) of the intermediate transfer belt 31 and the photosensitive drums 2Y, 2M, 2C, and 2K. The primary transfer rollers 35Y, 35M, 35C, and 35K are supplied with a primary bias supplied by a transfer bias power source, thereby generating a transfer electric field between each of the toner images formed on the photosensitive drums 2Y, 2M, 2C, and 2K, and the primary transfer rollers 35Y, 35M, 35C, and 35K. The toner image for yellow formed on the photosensitive drum 2Y enters the primary transfer nip as the photosensitive drum 2Y rotates. Subsequently, the toner image is transferred primarily from the photosensitive drum 2Y to the intermediate transfer belt 31 by the transfer electrical field and the nip pressure. This process is known as the primary transfer.

The intermediate transfer belt 31 on which the toner image of yellow has been transferred passes through the primary transfer nips of magenta, cyan, and black. Subsequently, the toner images on the photosensitive drums 2M, 2C, and 2K are superimposed on the yellow toner image which has been transferred on the intermediate transfer belt 31, one atop the other, thereby forming a composite toner image on the intermediate transfer belt 31 in the primary transfer process. Accordingly, a composite toner image, in which the toner images of yellow, magenta, cyan, and black are superimposed on one another, is formed on the surface of the intermediate transfer belt 31 in the primary transfer.

Each of the primary transfer rollers 35Y, 35M, 35C, and 35K is constituted of an elastic roller including a metal cored bar on which a conductive sponge layer is fixated. The shaft center of each of the shafts of the primary transfer rollers 35Y, 35M, 35C, and 35K is approximately 2.5 mm off from the shaft center of the shafts of the photosensitive drums 2Y, 2M, 2C, and 2K toward the downstream side in the direction of movement of the intermediate transfer belt 31. The primary transfer rollers 35Y, 35M, 35C, and 35K described above are supplied with a constant-current controlled primary transfer bias. According to the present illustrative embodiment, roller-type primary transfer devices, that is, the primary transfer rollers 35Y, 35M, 35C, and 35K, are employed as primary transfer devices. Alternatively, a transfer charger and a brush-type transfer device may be employed as a primary transfer device.

As illustrated in FIG. 1, the nip forming roller 36 of the transfer unit 30 is disposed outside the loop formed by the intermediate transfer belt 31, opposite the secondary-transfer back surface roller 33 which is disposed inside the loop. The intermediate transfer belt 31 is interposed between the secondary-transfer back surface roller 33 and the nip forming roller 36. Accordingly, a secondary transfer nip N is formed between the peripheral surface or the image bearing surface of the intermediate transfer belt 31 and the nip forming roller 36 contacting the peripheral surface of the intermediate transfer belt 31.

In the example shown in FIGS. 1 and 2, the nip forming roller 36 is grounded. The secondary-transfer back surface roller 33 disposed inside the looped belt is supplied with a secondary transfer voltage supplied from a power source 39. With this configuration, the secondary transfer bias is applied between the secondary-transfer back surface roller 33 and the nip forming roller 36, and a secondary transfer electric field is formed in the secondary transfer nip N between the secondary-transfer back surface roller 33 and the nip forming roller 36. The secondary transfer electric field causes the toner to move electrostatically from the secondary-transfer back surface roller side to the nip forming roller side.

As illustrated in FIG. 1, a sheet cassette 100 storing a stack of recording media sheets P is disposed below the transfer unit 30. The sheet cassette 100 is equipped with a sheet feed roller 100*a* to contact a top sheet of the stack of recording media sheets P. As the sheet feed roller 100*a* is rotated at a predetermined speed, the sheet feed roller 100*a* picks up the top sheet and feeds it to a sheet passage in the image forming apparatus. Substantially at the end of the sheet passage, a pair of registration rollers 101 is disposed. The pair of the registration rollers 101 stops rotating temporarily, immediately after the recording medium P delivered from the sheet cassette 100 is interposed therebetween. The pair of registration rollers 101 starts to rotate again to feed the recording medium P to the secondary transfer nip N in appropriate timing such that the recording medium P is aligned with the composite toner image formed on the intermediate transfer belt 31 in the secondary transfer nip N.

In the secondary transfer nip N, the recording medium P tightly contacts the composite toner image on the intermediate transfer belt 31, and the composite toner image is transferred onto the recording medium P by the secondary transfer electric field and the nip pressure applied thereto, thereby forming a color image on the surface of the recording medium P. The recording medium P on which the composite color toner image is formed passes through the secondary transfer nip N and separates from the nip forming roller 36 and the intermediate transfer belt 31 due to the curvature of the rollers.

The secondary-transfer back surface roller 33 is constituted of a metal cored bar on which a conductive nitrile rubber (NBR) layer is disposed. The nip forming roller 36 is formed of a metal cored bar on which the conductive NBR rubber layer is disposed.

The power source 39 includes a direct current (DC) power source and an alternating current (AC) power source to transfer the toner image from the intermediate transfer belt 31 to the recording medium P interposed in the secondary transfer nip N. The power source 39 can output a superimposed transfer bias in which an AC voltage is superimposed on a DC voltage. According to the present illustrative embodiment as shown in FIG. 1, the nip forming roller 36 is grounded while the power source 39 is connected to the secondary-transfer back surface roller 33.

Figure 3:
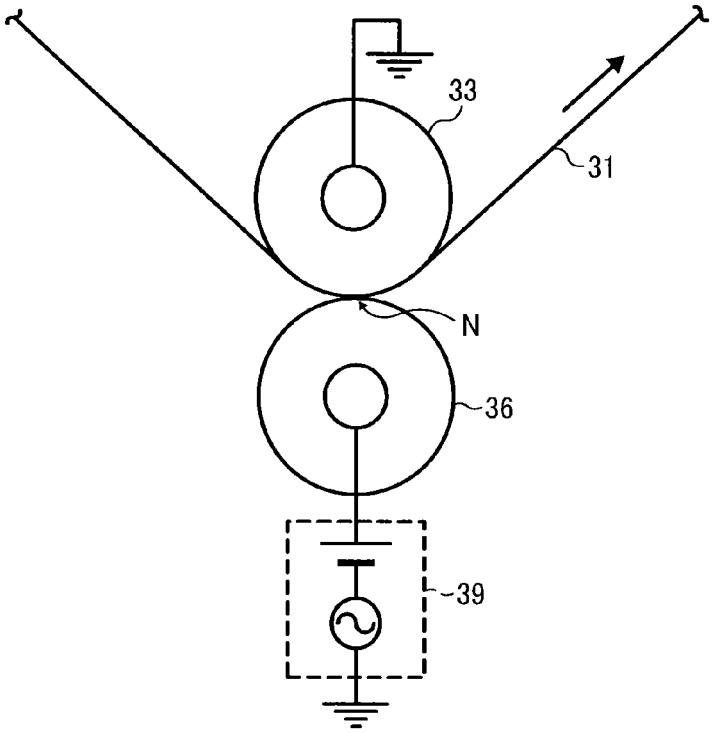
FIG. 3 is a schematic diagram illustrating a secondary transfer portion and a power source employed in the image forming apparatus of FIG. 1 in a configuration in which a DC transfer bias and a superimposed transfer bias are switched according to an illustrative embodiment of the present disclosure.

Application of the secondary transfer bias is not limited to the embodiment shown in FIG. 1. Alternatively, as illustrated in FIG. 3, the secondary-transfer back surface roller 33 is grounded while the secondary transfer voltage from the power source 39 is supplied to the nip forming roller 36. In this case, the polarity of the DC voltage is changed. More specifically, as illustrated in FIG. 1, when the secondary transfer voltage is applied to the secondary-transfer back surface roller 33 under the condition in which the toner has a negative polarity and the nip forming roller 36 is grounded, the DC component of the same negative polarity as the toner is used so that a time-averaged potential of the secondary transfer voltage is of the same negative polarity as the toner.

By contrast, as illustrated in FIG. 3, in a case in which the secondary-transfer back surface roller 33 is grounded and the secondary transfer voltage is supplied to the nip forming roller 36, the secondary transfer voltage having the DC component with a positive polarity opposite that of the toner is used so that the time-averaged potential of the secondary transfer voltage has the positive polarity opposite that of the toner.

Figure 4:
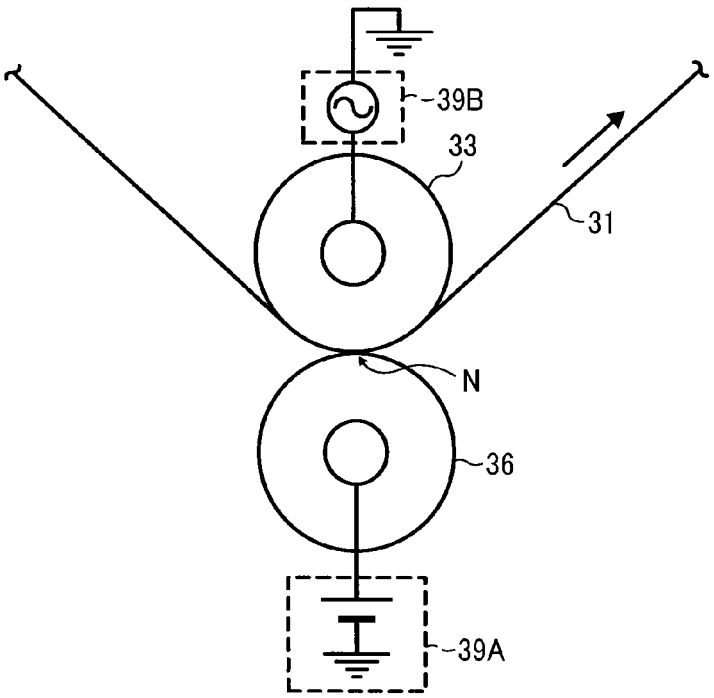
FIG. 4 is a schematic diagram illustrating the secondary transfer portion and the power source according to another illustrative embodiment of the present disclosure.
Figure 5:
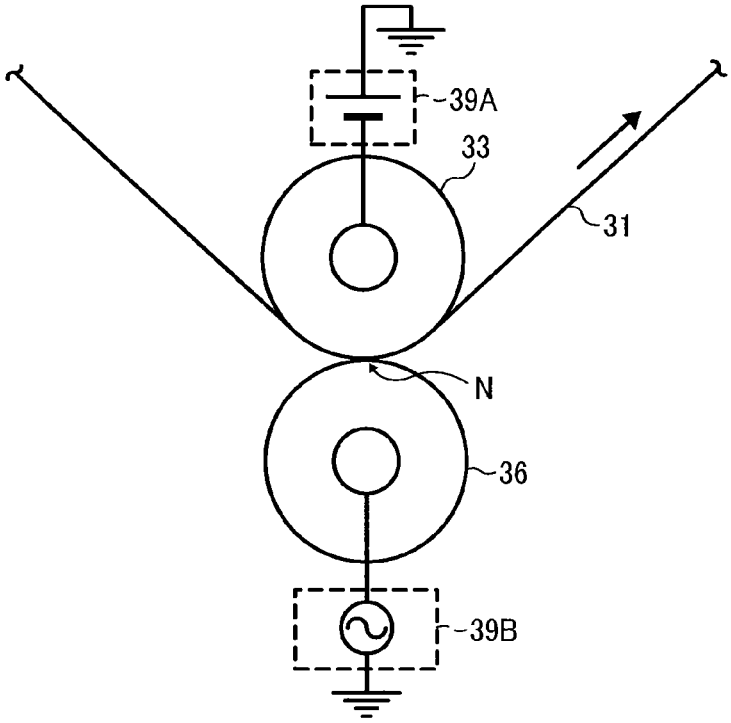
FIG. 5 is a schematic diagram illustrating the secondary transfer portion and the power source according to another illustrative embodiment of the present disclosure.
Figure 6:
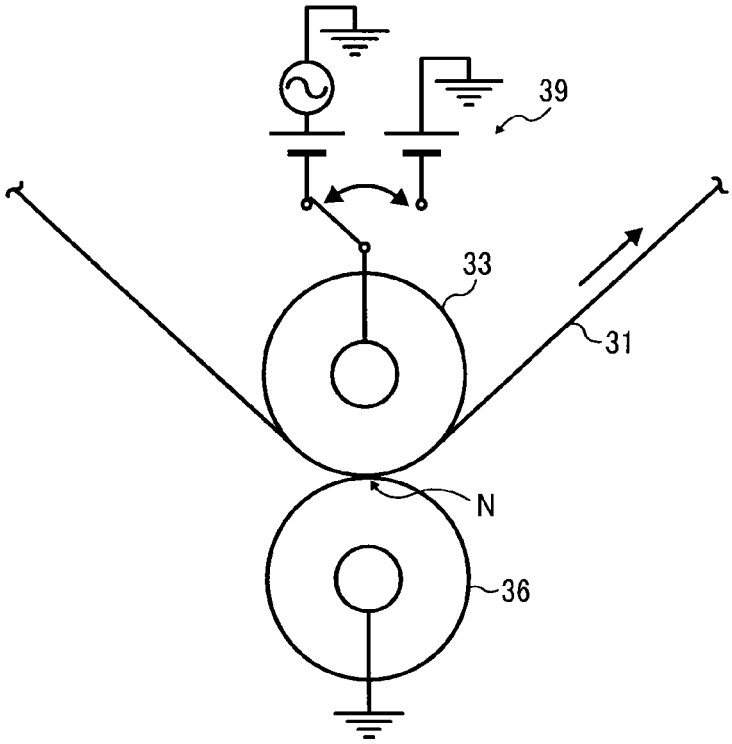
FIG. 6 is a schematic diagram illustrating the secondary transfer portion and the power source according to another illustrative embodiment of the present disclosure.
Figure 7:
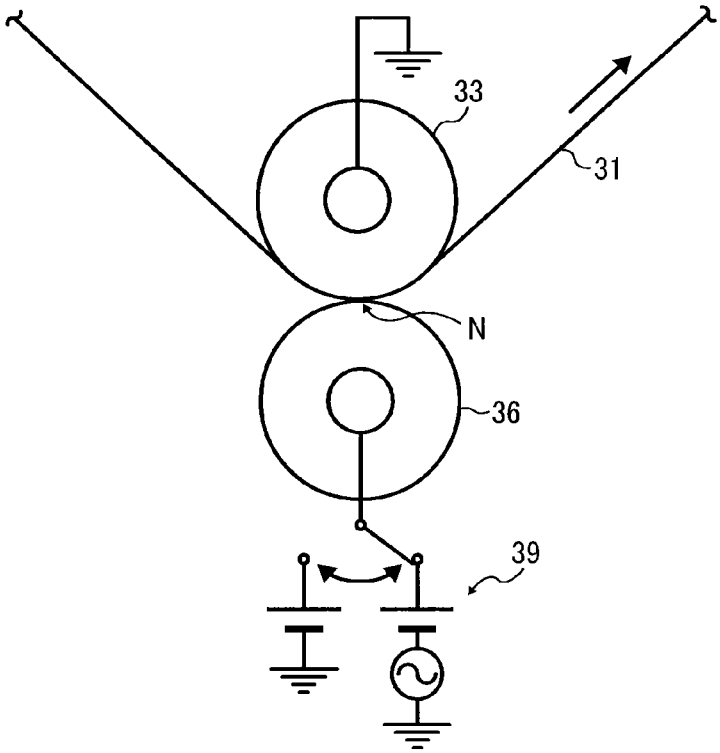
FIG. 7 is a schematic diagram illustrating the secondary transfer portion and the power source according to another illustrative embodiment of the present disclosure.

Alternatively, as illustrated in FIGS. 4 and 5, the DC voltage is supplied to one of the secondary-transfer back surface roller 33 and the nip forming roller 36 by a power source 39A while the AC voltage is supplied to the other roller by a power source 39B. Furthermore, application of the secondary transfer bias is not limited to the configurations described above. Alternatively, as illustrated in FIGS. 6 and 7, the power source 39 can switch between a combination of the DC voltage and the AC voltage, and the DC voltage alone, and supply the voltage to one of the secondary-transfer back surface roller 33 and the nip forming roller 36. For example, in one example shown in FIG. 6, the power source 39 switches the voltage between the combination of the DC voltage and the AC voltage, and the DC voltage, and supplies the voltage to the secondary-transfer back surface roller 33. In the example shown in FIG. 7, the power source 39 switches the voltage between the combination of the DC voltage and the AC voltage, and the DC voltage, and supplies the voltage to the nip forming roller 36.

Figure 8:
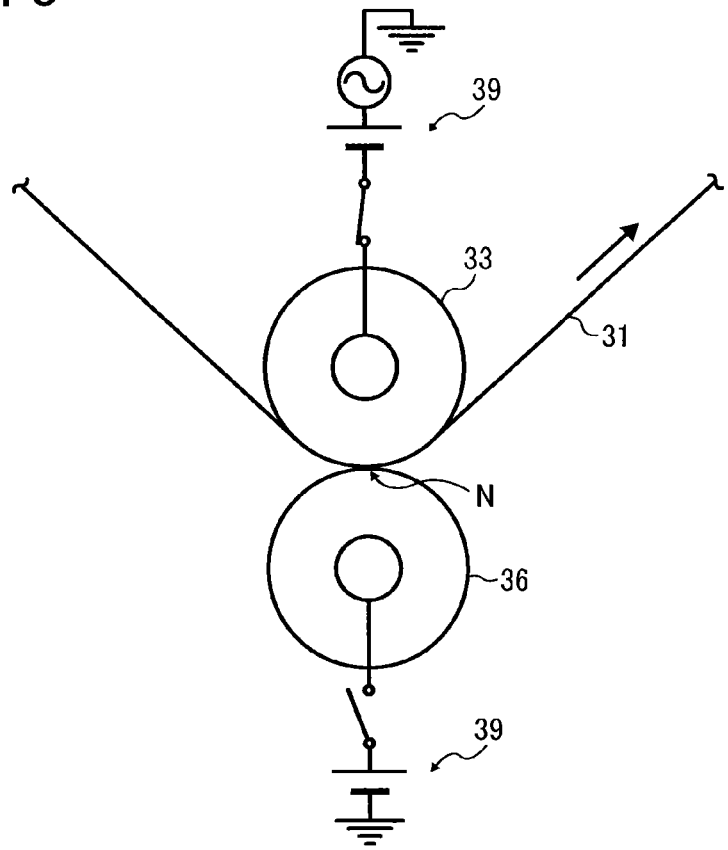
FIG. 8 is a schematic diagram illustrating the secondary transfer portion and the power source according to another illustrative embodiment of the present disclosure.
Figure 9:
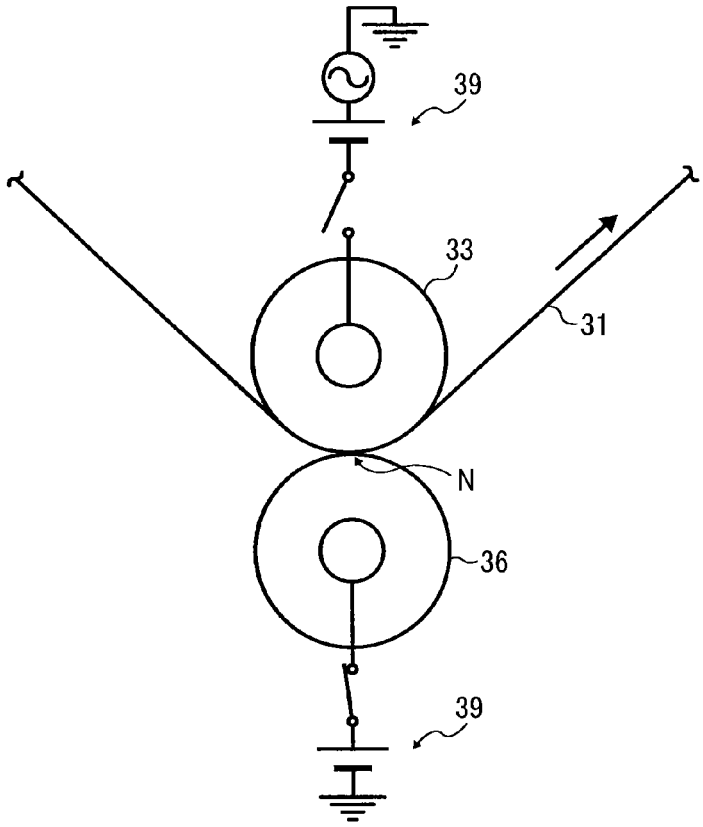
FIG. 9 is a schematic diagram illustrating the secondary transfer portion and the power source according to another illustrative embodiment of the present disclosure.

Alternatively, in a case in which the secondary transfer bias is switched between the combination of the DC voltage and the AC voltage, and the DC voltage, as illustrated in FIGS. 8 and 9, the combination of the DC voltage and the AC voltage is supplied to one of the secondary-transfer back surface roller 33 and the nip forming roller 36 while supplying the DC voltage to the other roller. For example, in one example shown in FIG. 8, the combination of the DC voltage and the AC voltage can be supplied to the secondary-transfer back surface roller 33, and the DC voltage can be supplied to the nip forming roller 36. In one example shown in FIG. 9, the DC voltage can be supplied to the secondary-transfer back surface roller 33, and the combination of the DC voltage and the AC voltage can be supplied to the nip forming roller 36.

As described above, there is a variety of ways in which the secondary transfer bias is applied to the secondary transfer nip N. Thus, depending on the secondary transfer bias application, any suitable power source may be selected. For example, a power source capable of supplying the combination of the DC voltage and the AC voltage may be employed. Alternatively, the power source capable of supplying the DC voltage and the AC voltage independently may be employed. Still alternatively, a single power source capable of switching the bias between the combination of the DC voltage and the AC voltage, and the DC voltage may be employed.

According to the present illustrative embodiment, the power source 39 for the secondary transfer bias includes a first mode in which the power source 39 outputs only the DC voltage and a second mode in which the power source 39 outputs a superimposed voltage including the AC voltage superimposed on the DC voltage. The power source 39 can switch between the first mode and the second mode. According to the illustrative embodiments shown in FIG. 1 and FIGS. 3 through 5, the first mode and the second mode can be switched by turning on and off the output of the AC voltage. According to the illustrative embodiments shown in FIGS. 6 through 9, a plurality of power sources (here, two power sources) is employed and switched selectively by a switching device such as a relay. By switching selectively between the two power sources, the first mode and the second mode may be selectively switched.

For example, when using a standard sheet of paper, such as the one having a relatively smooth surface, a pattern of dark and light according to the surface conditions of the sheet is less likely to appear on the recording medium. In this case, the power source 39 carries out the first mode and outputs the secondary transfer voltage consisting only of the DC voltage. By contrast, when using a recording medium such as pulp paper having a rough surface, the power source 39 carries out the second mode and outputs a superimposed voltage in which the AC voltage is superimposed on the DC voltage as a secondary transfer bias. In other words, in accordance with a type (a degree of surface roughness) of the recording medium P, the operational mode of the power source 39 is switched between the first mode and the second mode.

After the intermediate transfer belt 31 passes through the secondary transfer nip N, the residual toner not having been transferred onto the recording medium P remains on the intermediate transfer belt 31. The residual toner is removed from the intermediate transfer belt 31 by the belt cleaning device 37 which contacts the surface of the intermediate transfer belt 31. The cleaning backup roller 34 disposed inside the loop formed by the intermediate transfer belt 31 supports the cleaning operation performed by the belt cleaning device 37 from inside the loop of the intermediate transfer belt 31 so that the residual toner remaining on the intermediate transfer belt 31 is removed reliably.

The fixing device 90 is disposed on the right side in FIG. 1, that is, downstream from the secondary transfer nip N in the direction of conveyance of the recording medium P. The fixing device 90 includes a fixing roller 91 and a pressing roller 92. The fixing roller 91 includes a heat source such as a halogen lamp inside thereof. While rotating, the pressing roller 92 pressingly contacts the fixing roller 91, thereby forming a heated area called a fixing nip therebetween. The recording medium P bearing an unfixed toner image on the surface thereof is delivered to the fixing device 90 and interposed between the fixing roller 91 and the pressing roller 92. The surface of the recording medium P bearing the unfixed toner image tightly contacts the fixing roller 91. Under heat and pressure, toner adhered to the toner image is softened and fixed to the recording medium P in the fixing nip. Subsequently, the recording medium P is discharged outside the image forming apparatus from the fixing device 90 along the sheet passage after fixing.

Figure 10:
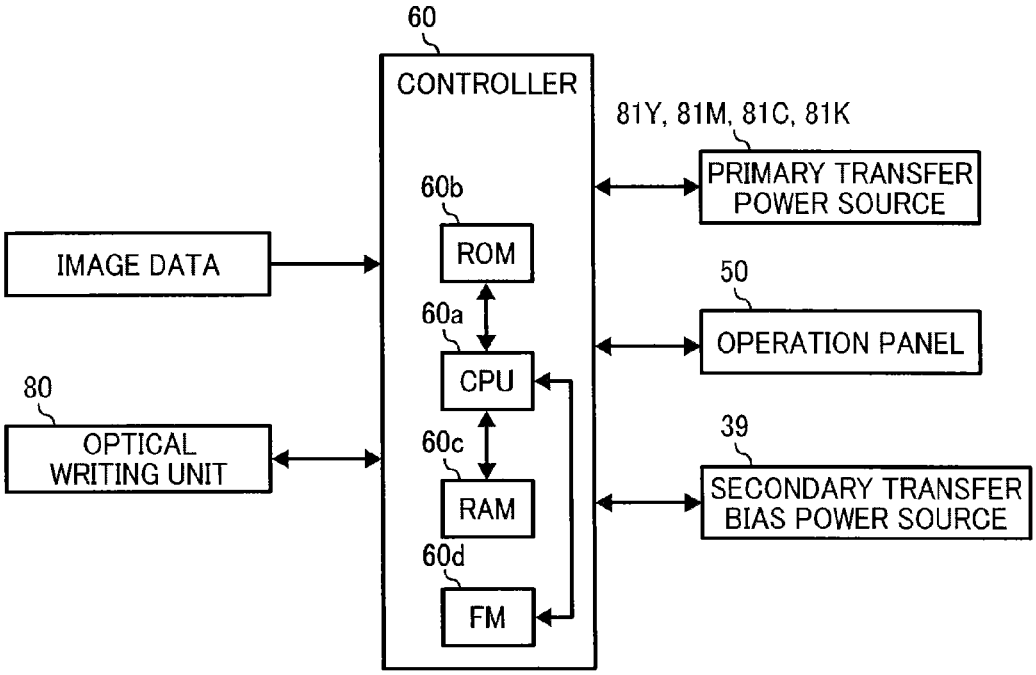
FIG. 10 is a block diagram illustrating a portion of a control system of the image forming apparatus.

FIG. 10 is a block diagram illustrating a control system of the image forming apparatus of FIG. 1.

As illustrated in FIG. 10, the controller 60 constituting a part of the transfer bias generator includes a Central Processing Unit (CPU) 60*a* serving as an operation device, a Random Access Memory (RAM) 60*c* serving as a nonvolatile memory, a Read-Only Memory (ROM) 60*b* serving as a temporary storage device, and a flash memory (FM) 60*d*. The controller 60 controlling the entire image forming apparatus is connected to a variety of devices and sensors. FIG. 1, however, illustrates only the devices associated with the characteristic configuration of the image forming apparatus of the illustrative embodiments of the present disclosure.

Primary transfer bias power sources 81Y, 81M, 81C, and 81K supply a primary transfer bias to the primary transfer rollers 35Y, 35M, 35C, and 35K. The power source 39 for secondary transfer outputs a secondary transfer voltage for application of the secondary transfer bias to the secondary transfer nip N. According to the present illustrative embodiment, the power source 39 outputs the secondary transfer voltage to be supplied to the secondary-transfer back surface roller 33. The control panel 50 includes a touch panel and a keypad. The control panel 50 displays an image on a screen of the touch panel, and receives an instruction entered by users using the touch panel and the keypad. The control panel 50 is capable of showing an image on the touch panel on the basis of a control signal transmitted from the controller 60.

According to the present illustrative embodiment, the controller 60 can carry out different printing modes including, but not limited to, a normal mode, a high-quality mode, and a high-speed mode. In the normal mode, a process linear velocity, that is, a linear velocity of the photosensitive drum and the intermediate transfer belt, is approximately 280 mm/s. It is to be noted that the process linear velocity in the high quality mode in which priority is given to image quality over the printing speed is slower than that in the normal mode.

On the contrary, the process linear velocity in the high-speed mode in which priority is given to the printing speed over the image quality is faster than that in the normal mode. Users can change the print modes between the normal mode, the high-quality mode, and the high-speed mode through the control panel 50 of the image forming apparatus or through a printer property menu in a personal computer connected to the image forming apparatus.

In a case in which a monochrome image is formed, a movable support plate supporting the primary transfer rollers 35Y, 35M, and 35C of the transfer unit 30 is moved to separate the primary transfer rollers 35Y, 35M, and 35C from the photosensitive drums 2Y, 2M, and 2C. Accordingly, the front surface of the intermediate transfer belt 31, that is, the image bearing surface, is separated from the photosensitive drums 2Y, 2M, and 2C so that the intermediate transfer belt 31 contacts only the photosensitive drum 2K for the color of black. In this state, only the image forming unit 1K is activated to form a toner image of the color black on the photosensitive drum 2K.

According to the present illustrative embodiment, the DC component of the secondary transfer voltage has the same value as the time-averaged value (Vave) of the secondary transfer voltage. The time-averaged value Vave of the secondary transfer voltage is a value obtained by dividing an integral value of a voltage waveform over one cycle by the length of one cycle.

In the image forming apparatus of the illustrative embodiment in which the secondary transfer voltage is supplied to the secondary-transfer back surface roller 33 and the nip forming roller 36 is grounded, when the polarity of the secondary transfer voltage is negative so is the polarity of the toner, the toner having the negative polarity is moved electrostatically from the secondary-transfer back surface roller side to the nip forming roller side in the secondary transfer nip N. Accordingly, the toner on the intermediate transfer belt 31 is transferred onto the recording medium P. By contrast, when the polarity of the secondary transfer voltage is opposite that of the toner, that is, the polarity of the secondary transfer voltage is positive, the toner having negative polarity is attracted electrostatically to the secondary-transfer back surface roller side from the nip forming roller side. Consequently, the toner having been transferred to the recording medium P is attracted again to the intermediate transfer belt 31.

When using paper having a rough surface such as Japanese paper known as "Washi", a pattern of light and dark according to the surface conditions of the paper appears easily in an image. As described above, in order to prevent such an image defect, not only a DC voltage alone, but also a superimposed voltage consisting of a DC voltage superimposed on an AC voltage is supplied as a secondary transfer voltage. A description is provided of why the pattern of light and dark patches in accordance with the surface conditions of the paper can be improved using the superimposed bias as the secondary transfer voltage.

Figure 11:
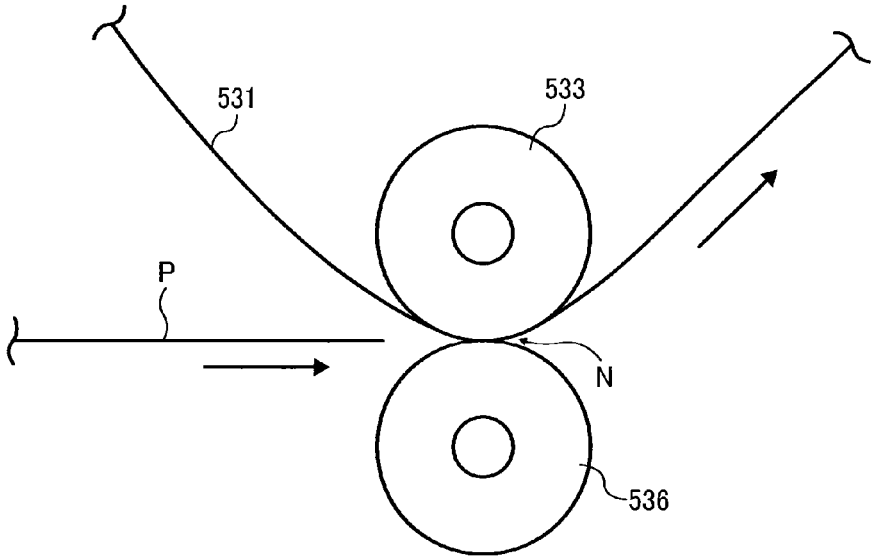
FIG. 11 is a schematic diagram illustrating an example of a secondary transfer nip where a secondary-transfer back surface roller and a nip forming roller meet and press against each other via an intermediate transfer belt.

FIG. 11 is a schematic diagram illustrating an example of a related-art secondary transfer nip N where a secondary-transfer back surface roller 533 and a nip forming roller 536 meet and press against each other via an intermediate transfer belt 531.

More specifically, the secondary-transfer back surface roller 533 contacts the rear surface of the intermediate transfer belt 531 and presses the intermediate transfer belt 531 against the nip forming roller 536. The secondary transfer nip N is formed between the peripheral surface or the image bearing surface of the intermediate transfer belt 531 and the nip forming roller 536 contacting the surface of the intermediate transfer belt 531. In the secondary transfer nip N, a toner image on the intermediate transfer belt 531 is transferred secondarily onto a recording medium P fed to the secondary transfer nip N between the intermediate transfer belt 531 and the nip forming roller 536. The secondary transfer voltage is supplied to one of the nip forming roller 536 and the secondary-transfer back surface roller 533, and the other one of these rollers is grounded so as to form the secondary transfer bias for transferring the toner image onto a recording medium P. The toner image can be transferred onto the recording medium P by supplying the secondary transfer voltage either to the nip forming roller 536 or to the secondary-transfer back surface roller 533.

Here, a description is provided of an example of application of the secondary transfer voltage to the secondary-transfer back surface roller 533 when using toner having a negative polarity. In this case, in order to move the toner in the secondary transfer nip N from the secondary-transfer back surface roller side to the nip forming roller side, a superimposed voltage is supplied as the secondary transfer voltage. More specifically, a time-averaged value of the secondary transfer voltage has the same negative polarity as that of the toner.

Figure 12:
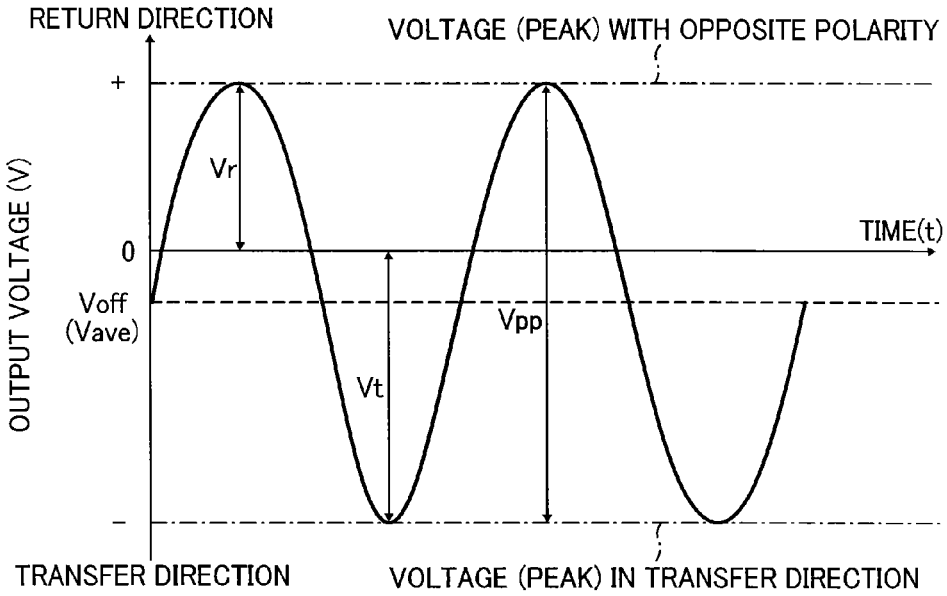
FIG. 12 is a waveform chart showing an example of a waveform of a superimposed voltage as a secondary transfer voltage.

With reference to FIG. 12, a description is provided of the secondary transfer voltage using the superimposed voltage supplied to the secondary-transfer back surface roller 533. FIG. 12 is a waveform chart showing an example of a waveform of the superimposed voltage as the secondary transfer bias.

In FIG. 12, the time-averaged value Vave (V) represents a time-averaged value of the secondary transfer voltage. As shown in FIG. 12, the secondary transfer voltage has a sinusoidal waveform having a peak at a return direction side and a peak at a transfer direction side. In FIG. 12, a reference sign Vt refers to one of the two peak values, that is, the peak value at the transfer direction side for moving the toner from the belt side to the nip forming roller side (referred to as the transfer direction side). Thereafter, this peak value is referred to as a transfer peak value Vt. A reference sign Vr refers to the other peak value, that is, the peak value at the return direction side for returning the toner from the nip forming roller side to the belt side (return direction side). Thereafter, this peak value is referred to as a return peak value Vr.

Instead of the secondary transfer voltage shown in FIG. 12, even when the secondary transfer voltage including only the AC component is supplied, it is still possible to move the toner back and forth between the intermediate transfer belt 531 and the recording medium P in the secondary transfer nip N. However, such a secondary transfer voltage simply moves the toner back and forth between the intermediate transfer belt 531 and the recording medium P, but does not transfer the toner onto the recording medium P. If the superimposed voltage including the DC component is supplied as a secondary transfer voltage and the time-averaged value Vave V has the same negative polarity as the toner, it is possible to move the toner relatively from the belt side toward the recording medium P while moving the toner back and forth between the belt side and the recording medium side. Ultimately, the toner can be transferred onto the recording medium P.

According to the experiments performed by the present inventors, when application of the secondary transfer bias is initiated, only a very small number of toner particles on the surface of a toner layer on the intermediate transfer belt 531 first separates from the toner layer and moves toward recessed portions of the surface of the recording medium P. However, most of the toner particles in the toner layer remain therein. The very small number of toner particles separated from the toner layer enters the recessed portions of the surface of the recording medium P.

Subsequently, when the direction of the electric field is reversed, the toner particles return from the recessed portions to the toner layer. When this happens, the toner particles returning to the toner layer strike the toner particles remaining in the toner layer so that adhesion of the toner particles to the toner layer (or to the recording medium P) is weakened. As a result, when the polarity of the electric field reverses towards the direction of the recording medium P, more toner particles than in the initial time separate from the toner layer and move to the recessed portions of the recording medium P.

As this process is repeated, the amount of toner particles separating from the toner layer and entering the recessed portions of the recording medium is increased gradually. Consequently, a sufficient amount of toner particles is transferred to the recessed portions of the recording medium P.

Figure 13:
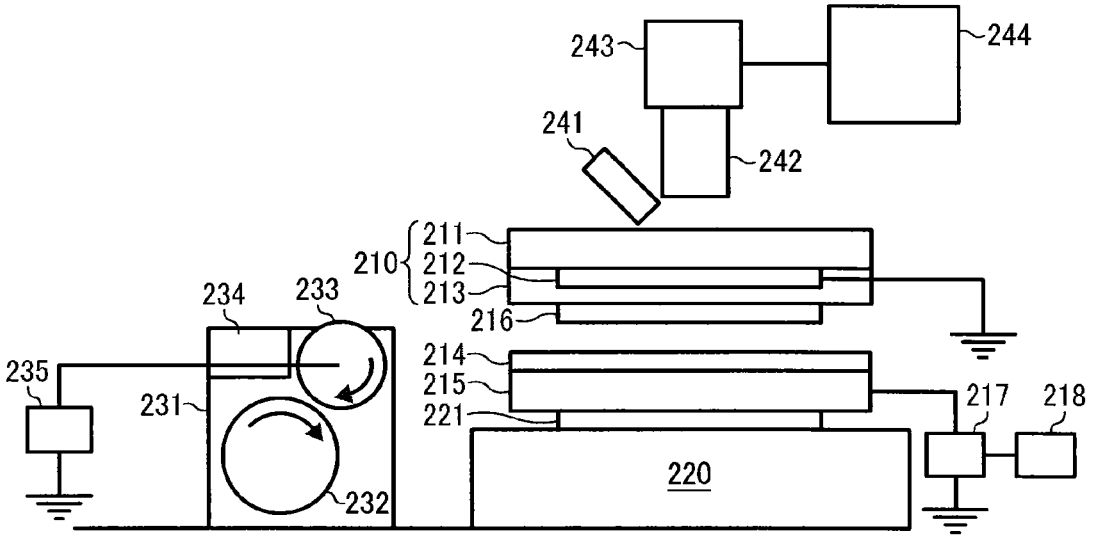
FIG. 13 is a schematic diagram illustrating an observation equipment for observation of behavior of toner in the secondary transfer nip.

Next, with reference to FIG. 13, a description is provided of transfer experiments performed by the present inventors.

The present inventors performed observation experiments using special observation equipment shown in FIG. 13. FIG. 13 is a schematic diagram illustrating the observation equipment for observation of behavior of toner in the secondary transfer nip N. The observation equipment includes a transparent substrate 210, a metal plate 215, a substrate 221, a development device 231, a power supply 235, a Z stage 220, a light source 241, a microscope 242, a high-speed camera 243, a personal computer 244, a voltage amplifier 217, a waveform generator 218, and so forth.

The transparent substrate 210 includes a glass plate 211, a transparent electrode 212 made of Indium Tin Oxide (ITO) and disposed on a lower surface of the glass plate 212, and a transparent insulating layer 213 made of a transparent material covering the transparent electrode 212. The transparent substrate 210 is supported at a predetermined height position by a substrate support. The substrate support is allowed to move in the vertical and horizontal directions in FIG. 13 by a moving assembly. In the illustrated example shown in FIG. 12, the transparent substrate 210 is located above the metal plate 215 placed on the Z stage 220.

In accordance with the movement of the substrate support, the transparent substrate 210 can be moved to a position directly above the development device 231 disposed lateral to the Z stage 220. The transparent electrode 212 of the transparent substrate 210 is connected to a grounded electrode fixed to the substrate support.

The developing device 231 has a similar configuration to the developing device 8K illustrated in FIG. 2 of the illustrative embodiment, and includes a screw 232, a development roller 233, a doctor blade 234, and so forth. The development roller 233 is driven to rotate with a development bias applied thereto by a power source 235.

Movement of the substrate support causes the transparent substrate 210 to move at a predetermined speed to a position directly above the developing device 231 and disposed opposite the development roller 233 with a predetermined gap therebetween. Then, toner on the development roller 233 is transferred to the transparent electrode 212 of the transparent substrate 210. Thereby, a toner layer 216 having a predetermined thickness is formed on the transparent electrode 212 of the transparent substrate 210.

The toner adhesion amount per unit area in the toner layer 216 is adjustable by the toner density in the developing agent, the toner charge amount, the development bias value, the gap between the transparent substrate 210 and the developing roller 233, the moving speed of the transparent substrate 210, the rotation speed of the developing roller 233, and so forth.

The transparent substrate 210 formed with the toner layer 216 is translated to a position opposite a recording medium 214 adhered to the planar metal plate 215 by a conductive adhesive. The metal plate 215 is placed on the substrate 221 which is provided with a load sensor and placed on the Z stage 220. Further, the metal plate 215 is connected to the voltage amplifier 217. The waveform generator 218 provides the voltage amplifier 217 with a transfer voltage including a DC voltage and an AC voltage. The transfer voltage is amplified by the voltage amplifier 217, and the amplified transfer voltage is applied to the metal plate 215. If the Z stage 220 is driven and elevates the metal plate 215, the recording medium 214 starts coming into contact with the toner layer 216. If the metal plate 215 is further elevated, the pressure applied to the toner layer 216 increases. The elevation of the metal plate 215 is stopped when the output from the load sensor reaches a predetermined value.

With the pressure maintained at the predetermined value, a transfer voltage is supplied to the metal plate 215, and the behavior of the toner is observed. After the observation, the Z stage 220 is driven to lower the metal plate 215 and to separate the recording medium 214 from the transparent substrate 210. Thereby, the toner layer 216 is transferred onto the recording medium 214.

The behavior of the toner is examined using the microscope 242 and the high-speed camera 243 disposed above the transparent substrate 210. The transparent substrate 210 is formed of the layers of the glass plate 211, the transparent electrode 212, and the transparent insulating layer 213, which are all made of transparent material. It is therefore possible to observe, from above and through the transparent substrate 210, the behavior of the toner located under the transparent substrate 210.

In the present experiment, a microscope using a zoom lens VH-Z75 manufactured by Keyence Corporation was used as the microscope 242. Further, a camera FASTCAM-MAX 120KC manufactured by Photron Limited was used as the high-speed camera 243 controlled by the personal computer 244. The microscope 242 and the high-speed camera 243 are supported by a camera support. The camera support adjusts the focus of the microscope 242.

The behavior of the toner on the transparent substrate 210 was photographed as follows. That is, the position at which the behavior of the toner to be observed was illuminated with light by the light source 241, and the focus of the microscope 242 was adjusted. Then, the transfer voltage was applied to the metal plate 215 to move the toner in the toner layer 216 adhering to the lower surface of the transparent substrate 210 toward the recording medium 214. The behavior of the toner in this process was photographed by the high-speed camera 243.

The structure of the transfer nip in which toner is transferred onto a recording medium is different between the observation experiment equipment illustrated in FIG. 13 and the image forming apparatus of the illustrative embodiment. Therefore, the transfer electric field acting on the toner is different therebetween, even if the applied transfer voltage is the same. To find appropriate observation conditions, transfer voltage conditions allowing the observation experiment equipment to attain favorable density reproducibility on recessed portions of a surface of a recording medium were investigated.

As the recording medium 214, a sheet of FC Japanese paper SAZANAMI manufactured by NBS Ricoh Company, Ltd. was used. As the toner, yellow (Y) toner having an average toner particle diameter of approximately 6.8 μm mixed with a relatively small amount of black (K) toner was used. The observation experiment equipment is configured to apply the transfer voltage to a rear surface of the recording medium 214 (i.e., SAZANAMI). Therefore, in the observation experiment equipment, the polarity of the transfer voltage capable of transferring the toner onto the recording medium 214 is opposite the polarity of the transfer voltage employed in the image forming apparatus according to the illustrative embodiment (i.e., positive polarity).

The transfer voltage to be applied had a sinusoidal waveform, and the frequency f of the AC component was set to approximately 1000 Hz. Further, the DC component (that is, the time-averaged value Vave in the illustrative embodiment) was set to approximately 200 V, and a peak-to-peak voltage Vpp was set to approximately 1000 V. The toner layer 216 was transferred onto the recording medium 214 with a toner adhesion amount in a range of from approximately 0.4 $mg/cm^2$ to approximately 0.5 $mg/cm^2$. As a result, a sufficient image density was successfully obtained on the recessed portions of the surface of the SAZANAMI paper sheet.

Under the above-described conditions, the behavior of the toner was photographed with the microscope 242 focused on the toner layer 216 on the transparent substrate 210, and the following phenomenon was observed. That is, the toner particles in the toner layer 216 moved back and forth between the transparent substrate 210 and the recording medium 214 due to an alternating electric field generated by the AC component of the transfer voltage. With an increase in the number of the back-and-forth movements, the amount of toner particles moving back and forth was increased.

Figure 14:
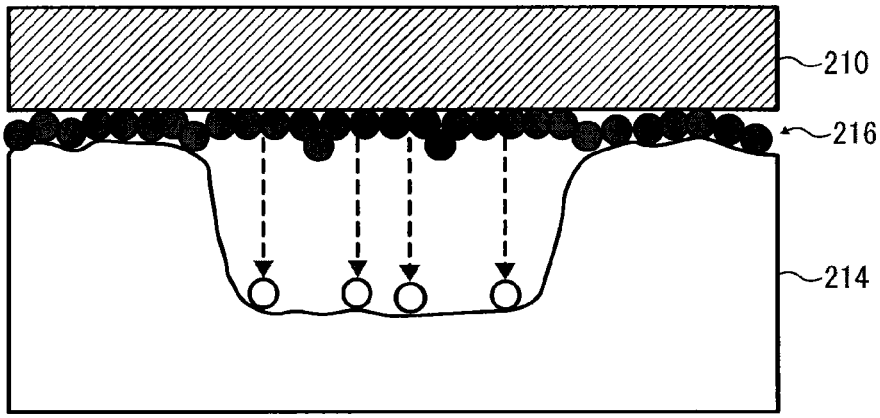
FIG. 14 is an enlarged schematic diagram illustrating behavior of toner in the secondary transfer nip at the beginning of transfer.
Figure 15:
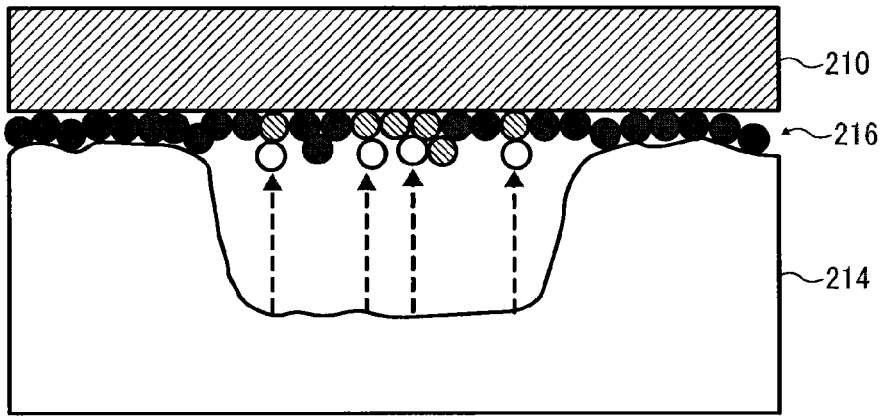
FIG. 15 is an enlarged schematic diagram illustrating behavior of the toner in the secondary transfer nip in the middle phase of transfer.

More specifically, in the transfer nip, there was one back-and-forth movement of toner particles in every cycle 1/f of the AC component of the secondary transfer voltage due to a single action of the alternating electric field. In the first cycle, only toner particles present on a surface of the toner layer 216 separated therefrom as illustrated in FIG. 14. The toner particles then entered the recessed portions of the recording medium 214, and thereafter returned to the toner layer 216, as illustrated in FIG. 15. In this process, the returning toner particles collided with other toner particles remaining in the toner layer 216, thereby reducing the adhesion of the other toner particles to the toner layer 216 or to the transparent substrate 210.

Figure 16:
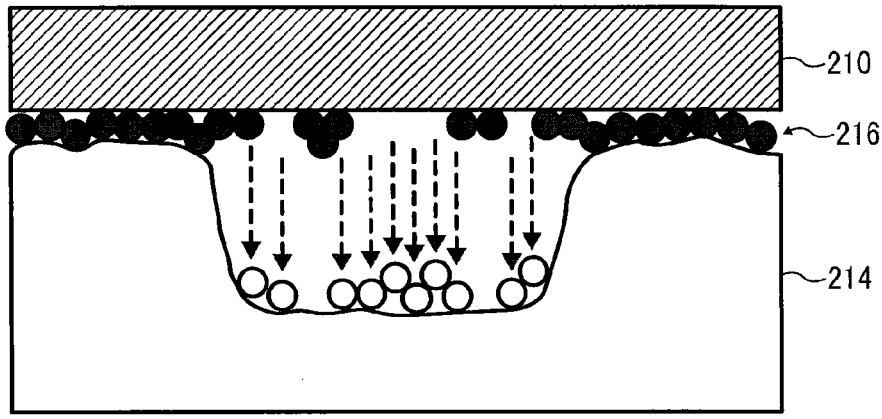
FIG. 16 is an enlarged schematic diagram illustrating movement of toner in the secondary transfer nip in the last phase of transfer.

In the next cycle, therefore, a larger amount of toner particles than in the previous cycle separated from the toner layer 216, as illustrated in FIG. 15. The toner particles then entered the recessed portions of the recording medium 214, and thereafter returned to the toner layer 216, as illustrated in FIG. 15. In this process, the returning toner particles collided with other toner particles remaining in the toner layer 216, thereby reducing the adhesion of the other toner particles to the toner layer 216 or to the transparent substrate 210. In the next cycle, therefore, a larger amount of toner particles than in the last cycle separated from the toner layer 216, as illustrated in FIG. 16. As described above, the number of toner particles moving back and forth was gradually increased every time the toner particles moved back and forth. After the lapse of a nip passage time, for example, a time corresponding to the actual nip passage time in the observation experiment equipment, a sufficient amount of toner had been transferred to the recessed portions of the recording medium 214.

Further, the behavior of the toner was photographed under conditions with a DC component (corresponding to the time-averaged value Vave according to the illustrative embodiment) of the secondary transfer voltage of approximately 200 V and the peak-to-peak voltage Vpp of approximately 800 V, and the following phenomenon was observed. It is to be noted that the peak-to-peak voltage Vpp is measured from a positive peak to a negative peak in one cycle, that is, the peak at the return direction side and the peak at the transfer direction side according to the illustrative embodiment. That is, some of the toner particles in the toner layer 216 present on the surface thereof separated from the toner layer 216 in the first cycle, and entered the recessed portions of the recording medium 214.

Subsequently, however, the toner particles entered the recessed portions remained therein, without returning to the toner layer 216. In the next cycle, a very small number of toner particles newly separated from the toner layer 216 and entered the recessed portions of the recording medium 214. After the lapse of the nip passage time, therefore, only a relatively small amount of toner particles had been transferred to the recessed portions of the recording medium 214.

The present inventors have recognized that an electrostatic capacity in the transfer nip contributes largely to the electric discharge in the transfer nip to which a superimposed transfer bias is supplied. More specifically, the electrostatic capacity (hereinafter referred to as transfer-nip electrostatic capacity) between the surface of the image bearing member and the surface of the recording medium contributes largely to the electric discharge. The greater is the transfer-nip electrostatic capacity, the greater is the electrical charge to be stored in the transfer nip between the image bearing surface and the recording medium. The electrical charge is stored gradually until the recording medium passes through the transfer nip. Thus, with a large transfer-nip electrostatic capacity, the potential difference between the surface of the image bearing member and the recording medium increases as the image bearing member and the recording medium approach the end of the transfer nip. As a result, an electric discharge occurs near the end of the transfer nip, causing the white spots.

The present inventors have also recognized that if the transfer-nip electrostatic capacity is reduced, the maximum potential difference between the image bearing member and the recording medium in the transfer nip can be reduced while keeping the peak-to-peak voltage to be applied to the transfer nip high, thereby suppressing generation of the electric discharge. Accordingly, the white spots can be prevented.

However, in reality, direct measurement of the transfer-nip electrostatic capacity is difficult, and thus it is difficult to design an image forming apparatus to have the transfer-nip electrostatic capacity within a specified target range. In view of the above, the present inventors have focused on a phase difference between an alternating current (AC) voltage and an AC current as a parameter that is highly correlated with the transfer-nip electrostatic capacity.

The AC voltage and the AC current are output from a power source. The phase difference between the AC voltage and the AC current output from the power source is a parameter that changes depending on the size of the transfer-nip electrostatic capacity in the transfer nip to which the AC voltage and the AC current are supplied. More specifically, the greater is the transfer-nip electrostatic capacity, the greater is the phase difference. Direct measurement of the phase difference between the AC voltage and the AC current output from the power source is possible, thereby facilitating designing of an image forming apparatus to achieve the phase difference within the specified target range.

According to the studies by the present inventors, when the phase difference is equal to or less than 0.47 cycles, generation of the white spots can be suppressed, if not prevented entirely, while keeping the peak-to-peak voltage of the superimposed transfer bias to be applied to the transfer nip high in a standard configuration of the image forming apparatus.

Figure 17:
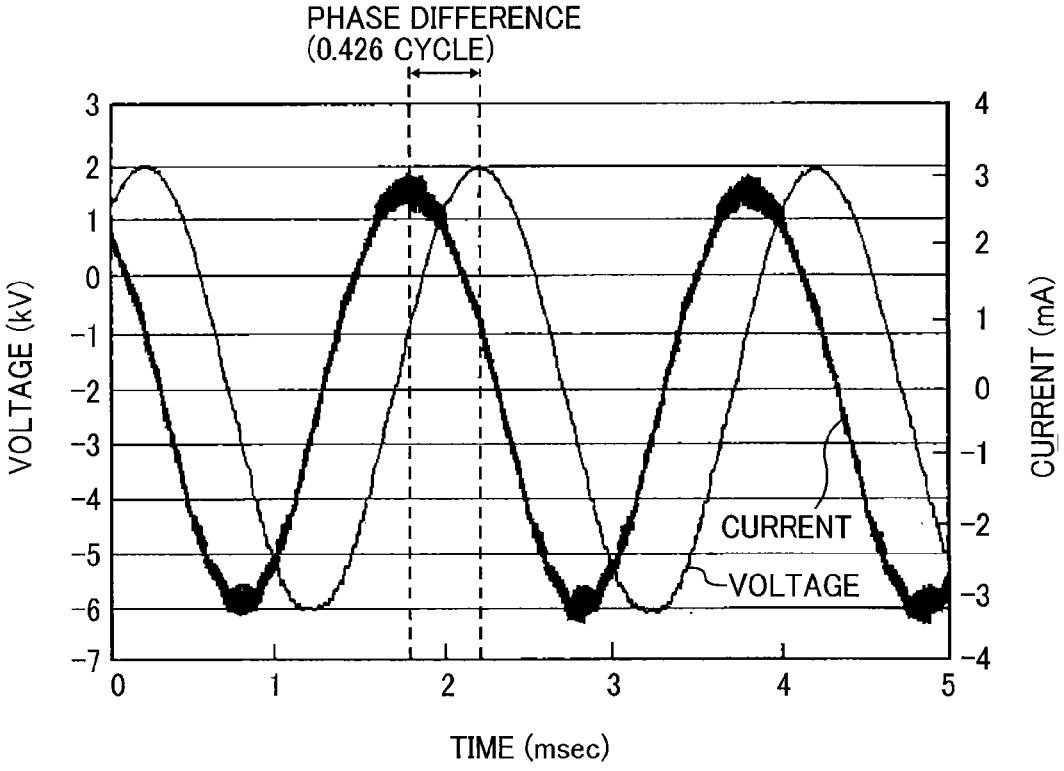
FIG. 17 is chart showing a phase difference between the secondary transfer voltage and a secondary transfer current supplied to the secondary-transfer back surface roller.

With reference to FIG. 17, a description is provided of a characteristic configuration of the image forming apparatus of the combination and a phase difference between an AC voltage and the AC current output from the power source 39 for the secondary transfer.

As described above, when applying the secondary transfer bias that causes the toner particle to move back and forth, the electric discharge occurs locally in the secondary transfer nip. The toner does not get transferred to the place at which the electric discharge occurs, thereby forming white spots in a resulting output image. According to the present illustrative embodiment, in order to prevent generation of the white spots, the phase difference between the AC voltage and the AC current output from the power source 39 is fewer than 0.47 cycles, preferably, less than or equal to 0.44 cycles.

When transferring the toner, a potential difference is generated in the secondary transfer nip N (more specifically, between the intermediate transfer belt 31 and the recording medium P) due to the electric current output from the power source 39. Because the secondary transfer nip N has an element of a capacitor, the waveform of the voltage output from the power source 39 is delayed with respect to the waveform of an electric current. As illustrated in FIG. 17, the phase difference is obtained from the waveform of the voltage and the waveform of the current observed at the output portion of the power source 39. The potential difference used in the present disclosure is expressed as a ratio of a time difference between a maximum value of the current and a maximum value of the voltage relative to one cycle.

Figure 19:
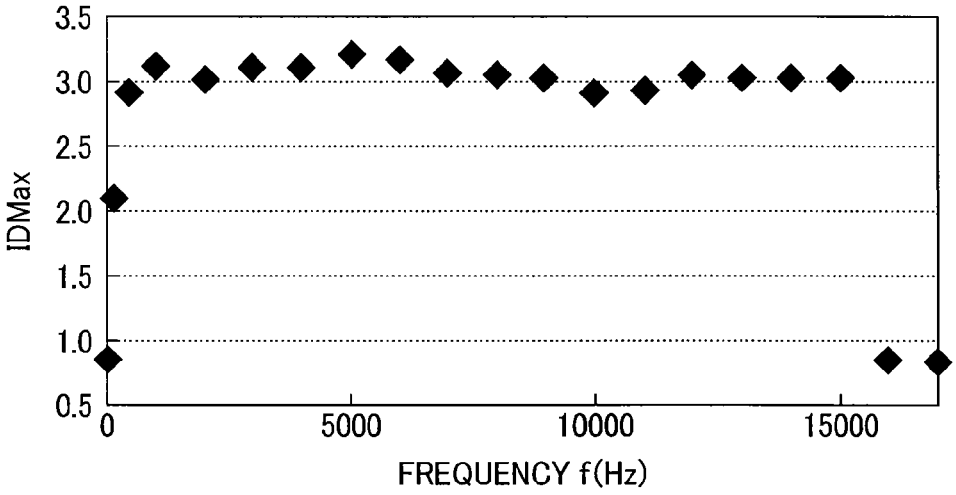
FIG. 19 is a graph showing a relation between an IDmax (maximum image density) of recessed portions of a surface of the recording medium and the frequency f of an AC component in an experiment 2.

With reference FIGS. 18 and 19, a description is provided of experiments performed by the present inventors.

Experiment 1

In an experiment 1, a test machine having the same configurations as the image forming apparatus shown in FIG. 1 was used for the following experiments. Various printing tests were performed using the test machine with the following settings:

Linear velocity (process linear velocity) of the intermediate transfer belt 31: 176 mm/s;

Frequency f of an AC component of the secondary transfer voltage output from the power source 39: 500 Hz;

Secondary transfer current output from the power source 39: −40 μA; and Recording medium P: Textured paper called "LEATHAC 66" (a trade name, manufactured by TOKUSHU PAPER MFG CO., LTD.) having a ream weight of 175 kg (hereinafter referred to as a 175 kg-sheet).

The degree of roughness of the surface of "LEATHAC 66" is greater than that of the above-mentioned "SAZANAMI". It is to be noted that the ream weight herein refers to a weight of 1000 sheets of paper having a size of 788 mm×1091 mm. The maximum depth of the recessed portions of the surface of LETHAC 66 was approximately 100 μm.

The experiments were performed under the temperature of 10° C. and the humidity of 15%.

As the power source 39, a function generator FG300 (manufactured by Yokogawa Meters & Instruments Corporation) was used to generate waveforms which were then amplified by 1000 times by an amplifier (Trek High-Voltage Amplifier Model 10/40 manufactured by TREK, INC.). The thus-obtained secondary transfer voltage and the secondary transfer current were then applied to the secondary-transfer back surface roller 33.

In the experiment 1, the phase difference between the AC voltage and the AC current output from the power source 39 for the secondary transfer was changed by changing the material constituting the secondary-transfer back surface roller 33. A solid blue image obtained by superimposing a magenta image and a cyan image was formed in print tests under different phase differences. White spots generated in the image at the projecting portions of the recording medium due to electric discharge were evaluated. A deficiency of image density at the recessed portions due to inadequate transferred toner was evaluated.

FIG. 18 is a table showing the results of the experiment 1.

As can be understood from FIG. 18, the evaluation of the white spots improves as the phase difference between the AC voltage and the AC current output from the power source 39 is reduced. According to the experiment 1, when the phase difference between the AC voltage and the AC current output from the power source 39 is equal to or less than 0.47 cycles, the white spots are evaluated as GOOD, which meets a target white-spot suppression level. When the phase difference between the AC voltage and the AC current output from the power source 39 is equal to or less than 0.44 cycles, the white spots are evaluated as EXCELLENT, which highly meets the target white-spot suppression level.

In view of the above, by reducing the phase difference between the AC voltage and the AC current output from the power source 39, the evaluation of the white spots is improved.

The occurrence of electric discharge in the secondary transfer nip N to which the superimposed transfer bias is applied depends largely on an electrostatic capacity in the secondary transfer nip N, more specifically, the electrostatic capacity (the transfer-nip electrostatic capacity) between the surface of the intermediate transfer belt 31 and the surface of the recording medium P. This is because when the transfer-nip electrostatic capacity is relatively large, the electrical charge stored between the intermediate transfer belt 31 and the recording medium P increases by the time the intermediate transfer belt 31 and the recording medium P pass the secondary transfer nip N. As a result, the potential difference increases near the end of the transfer nip, causing electric discharge near the end of the transfer nip.

In terms of the occurrence of electric discharge, by reducing the transfer-nip electrostatic capacity, the electrical charge to be stored in the secondary transfer nip N between the intermediate transfer belt 31 and the recording medium P can be reduced without reducing the peak-to-peak voltage of the superimposed transfer bias applied to the secondary transfer nip N. Accordingly, the potential difference between the intermediate transfer belt 31 and the recording medium P can be reduced, thereby suppressing the occurrence of electric discharge. However, in reality, the transfer-nip electrostatic capacity is not a parameter that can be measured directly, and it is difficult to design an image forming apparatus to have the transfer-nip electrostatic capacity within a specified target range.

In view of the above, according to the illustrative embodiment, as a parameter that is highly correlated with the transfer-nip electrostatic capacity, the phase difference between the AC voltage and the AC current output from the power source 39 is focused, and the relation between the phase difference and the occurrence of electric discharge (generation of white spots) is specified.

Although the transfer-nip electrostatic capacity changes significantly due to various reasons, the phase difference between the AC voltage and the AC current output from the power source 39 becomes relatively stable by controlling the power source 39 under the constant-current control and the constant voltage control, which facilitates designing of the image forming apparatus to have the phase difference within the target range.

According to the studies by the present inventors, with the phase difference of equal to or less than 0.47 cycles, the generation of white spots can be suppressed at the target white-spot suppression level when performing a standard image forming operation within a standard configuration. The target white-spot suppression level can be achieved with the phase difference of equal to or less than 0.47 cycles in the following conditions. Example conditions under which the image forming apparatus can achieve the target white-spot suppression level are provided below. It is to be noted that the parameters listed below are representative parameters that may affect the transfer-nip electrostatic capacity significantly.

[Thickness]

There is a correlation between the transfer-nip electrostatic capacity and the thickness of the recording medium P onto which the toner is transferred in the secondary transfer nip N. More specifically, the thicker is the recording medium, the lower is the transfer-nip electrostatic capacity.

The thickness of the recording medium P that allows suppression of the white spots at the target suppression level when satisfying the phase difference of equal to or less than 0.47 cycles has a basis weight in a range of from 30 gsm and 350 gsm.

[Volume Resistivity of Recording Medium]

There is a correlation between the transfer-nip electrostatic capacity and the volume resistivity of the recording medium P onto which the toner is transferred in the secondary transfer nip N. More specifically, the greater is the volume resistivity, the lower is the transfer-nip electrostatic capacity.

The volume resistivity of the recording medium P that allows suppression of the white spots at the target suppression level when satisfying the phase difference of equal to or less than 0.47 cycles is in a range of from $3.0\times10^{9}$ Ω·cm to $5.0\times10^{14}$ Ω·cm.

[Moisture Content]

There is a correlation between the transfer-nip electrostatic capacity and the moisture content of the recording medium P onto which the toner is transferred in the secondary transfer nip N. More specifically, the greater is the moisture content, the greater is the transfer-nip electrostatic capacity.

The moisture content of the recording medium P that allows suppression of the white spots at the target suppression level when satisfying the phase difference of equal to or less than 0.47 cycles is in a range of from 1.5 wt % to 9.0 wt %. It is to be noted, however, that depending on the humidity adjustment the moisture content may be 20 wt % or more. In this case, as long as the phase difference is equal to or less than 0.47 cycles, the target white-spot suppression level can be achieved.

[Absolute Humidity of Operating Environment]

There is a correlation between the transfer-nip electrostatic capacity and the absolute humidity of the operating environment. More specifically, the greater is the absolute humidity, the greater is the transfer-nip electrostatic capacity.

The absolute humidity of the operating environment that allows suppression of the white spots at the target suppression level when satisfying the phase difference of equal to or less than 0.47 cycles is in a range of from 1.0 g/m$^3$ to 35 g/m$^3$.

As described above, with a smaller phase difference, the white spots can be suppressed reliably. However, a too small phase difference causes an insufficient transfer electric field. More specifically, the toner transferability relative to the recessed portions of the recording medium surface is reduced, thereby reducing the image density at the recessed portions.

When the phase difference between the AC voltage and the AC current output from the power source 39 is small, it means a small transfer-nip electrostatic capacity. With a small transfer-nip electrostatic capacity, the charge is not stored adequately in the secondary transfer nip N between the intermediate transfer belt 31 and the recording medium P. Consequently, a sufficient potential difference is not formed between the intermediate transfer belt 31 and the recording medium P. The secondary transfer bias thus obtained is not sufficient enough to transfer the toner and hence the toner transferability is degraded due to insufficient transfer electric field.

According to the studies by the present inventors, as long as the image forming operation is performed within the conditions described above, as indicated by the results of the experiment 1, when the phase difference is equal to or greater than 0.37 cycles, degradation of the toner transferability at the recessed portions is suppressed, hence preventing a pattern of light and dark patches in accordance with the surface conditions (projections and recessed portions) of the recording medium P at a target suppression level. In particular, with the phase difference equal to or greater than 0.38 cycles, the image density is evaluated as "EXCELLENT", which highly meets the target.

In order to obtain such a phase difference, it is necessary to adjust the electrostatic capacity and the electrical resistance value of the transfer nip N. The phase difference can be adjusted by controlling the entire resistance value at the secondary transfer nip N. The entire resistance value at the secondary transfer nip is measured such that the nip forming roller 36 contacts the intermediate transfer belt 31 with the same conditions as when the recording medium passes through the nip, and a predetermined electric current is supplied to the nip forming roller 36 while being rotated at the same process linear velocity as when the recording medium passes through the nip. In this state, the voltage is monitored, and the entire resistance value of the secondary transfer nip N is measured.

Alternatively, the predetermined voltage is applied, and the electric current is monitored. In a case in which the image forming apparatus has a plurality of process linear velocities, the entire resistance value is measured for each process linear velocity.

By adjusting the entire resistance value of the secondary transfer nip N within a range of from $1.0\times10^{6}\Omega$ to $5.0\times10^{8}\Omega$, the phase difference between the AC voltage and the AC current output from the power source 39 can be adjusted easily within a range of from 0.37 cycles to 0.47 cycles. The entire resistance value is obtained from the electrical current when a voltage of −1 kV is supplied to the secondary-transfer back surface roller 33 using Trek COR-A-TROL Model 610D manufactured by TREK, INC.

Experiment 2

In an experiment 2, the present inventors studied a minimum threshold time "t1" at which toner once entered the recessed portions of the sheet surface was effectively returned onto the intermediate transfer belt 31 in the secondary transfer nip N. More specifically, under the returning time ratio of 50%, a frequency "f" of the AC component of the secondary transfer voltage was changed, and the image density of the solid blue image on the recessed portions was measured. FIG. 19 shows a relation between a maximum image density (ID-max) of the recessed portions and the frequency f of the AC component in the experiment.

Experiment 3

In an experiment 3, the solid blue image was output onto a standard paper sheet while changing the frequency "f" of the AC component and the process linear velocity v under the following condition:

Peak-to-peak voltage Vpp of AC component: 2500 V;
Offset voltage Voff: −800 V; and
Returning time ratio: 20%.

The resulting output image was visually inspected. Unevenness of image density (pitch unevenness) caused possibly by an alternating electric field in the secondary transfer nip N was evaluated. Under the same frequency f, the faster was the process linear velocity v, the more easily the pitch unevenness occurred. Under the same process linear velocity v, the lower was the frequency f, the more easily the pitch unevenness occurred.

These results indicate that the pitch unevenness occurs unless the toner moves back and forth between the intermediate transfer belt 31 and the recessed portions of the surface of the recording medium P for a number of times (n times) in the secondary transfer nip N.

When the process linear velocity v was 282 mm/s and the frequency f was 400 Hz, no pitch unevenness was observed. However, when the process linear velocity v was 282 mm/s and the frequency f was 300 Hz, the pitch unevenness was observed.

The width d of the secondary transfer nip N in the direction of movement of the belt was approximately 3 mm. The number n of back-and-forth movement of toner in the secondary transfer nip N in the condition under which no pitch unevenness was observed is calculated as approximately 4 times (3×400 Hz/282 mm/s), which is the minimum number of back-and-forth movement of toner, which does not cause pitch unevenness.

When the process linear velocity v was 141 mm/s and the frequency f was 200 Hz, no pitch unevenness was observed. However, when the process linear velocity v was 141 mm/s and the frequency f was 100 Hz, the pitch unevenness was observed. Similar to the condition in which the process linear velocity v was 282 mm/s and the frequency f was 400 Hz, the number n of back-and-forth movement of toner in the transfer nip N under the condition in which the process linear velocity v was 141 mm/s and the frequency f was 200 Hz was calculated as approximately 4 times (3 mm×200 Hz/141 mm/sec).

Therefore, when the relation "frequency $f>(4/d)\times v$" (Equation 1) is satisfied, an image without the pitch unevenness can be obtained.

In view of the above, according to the illustrative embodiment of the present invention, the AC component of the secondary transfer voltage is configured to satisfy the equation 1 described above. It is to be noted that in order to satisfy such a condition described above, the image forming apparatus includes the control panel 50 serving as an information receiver and a communication device that obtains printer driver setting information transmitted from external devices such as a personal computer (PC).

Based on the obtained information, the print mode is selected from the high-speed mode, the normal mode, and the slow-speed mode. Based on the selected print mode, the controller 60 determines the process linear velocity v. More specifically, according to the present illustrative embodiment, the controller 60 stores different process linear velocities v corresponding to each of the print modes, i.e., the high-speed mode, the normal mode, and the slow-speed mode. When the print mode is selected, the controller 60 determines the process linear velocity v. In accordance with the received information by the control panel 50, the controller 60 changes a preset target value of an output electrical current of the DC component. Here, the controller 60 serves as a changing device.

Experiment 4

It is known that in the secondary transfer nip N, toner is not transferred well onto the recording medium P unless a certain amount of transfer current flows through the recording medium P. As is obvious, the transfer current does not flow well through a relatively thick recording medium as compared with a recording medium having a standard thickness. Of course, it is desirable to transfer toner properly to embossed recording media sheets having a coarse surface such as Japanese paper known as "Washi", regardless of the thickness thereof. In view of this, in the experiment 4, how to control the secondary transfer voltage was studied.

In the experiment 4, as the secondary transfer power source 39, a power source that outputs a peak-to-peak voltage Vpp having an AC component and an offset voltage (center voltage value) Voff, both of which were subjected to constant voltage control, was employed. The process linear velocity v was 282 mm/s. As a recording medium P, LEATHAC 66 (a trade name) 175 kg-sheet having a ream weight of 175 kg was used, and an A4-size solid black test image was formed thereon. The returning time ratio was 40%. The offset voltage Voff was in a range of from approximately 800 V to approximately 1800 V. The peak-to-peak voltage Vpp was in a range of from approximately 3 kV to 8 kV. The frequency f was 500 Hz.

The image density of the solid black image on the recessed portions of the sheet surface was graded on a five point scale of 1 to 5, where 5 is the highest grade.

Grade 5: The recessed portions were filled with toner completely.

Grade 4: The recessed portions were filled with toner mostly, but a sheet portion was slightly seen in the recessed portions having a relatively large depth.

Grade 3: A sheet portion was clearly seen in the recessed portions having a relatively large depth.

Grade 2: An amount of the sheet portion seen in the recessed portions was worse than that in Grade 3, but better than Grade 1.

Grade 1: Toner was not adhered to the recessed portions at all.

The image density of the solid black image on the projecting portions of the sheet surface was graded on a five point scale of 1 to 5, where 5 is the highest grade.

Grade 5: There was no unevenness of image density, that is, good image density was obtained throughout the image.

Grade 4: There was slight unevenness of image density, but satisfying image density was obtained at the place at which the image density was relatively low.

Grade 3: There was unevenness of image density, and the place at which the image density was low was below an acceptable level.

Grade 2: Worse than Grade 3, but better than Grade 1.

Grade 1: The image density was inadequate throughout the image.

Subsequently, the evaluation of the image density of the recessed portions and the evaluation of the image density of the projecting portions are integrated as follows.

Grade A: The grades of image density of both recessed portions and projecting portions are Grade 5 or above.

Grade B: The grades of image density of both recessed portions and projecting portions are Grade 4 or above.

Grade C: The grade of image density of only recessed portions is Grade 3 or below.

Grade D: The grade of image density of only projecting portions is Grade 3 or below.

Grade E: The grades of image density of both recessed portions and projecting portions are Grade 3 or below.

Next, the same experiment was performed except that LEATHAC 66 having a ream weight of 215 kg which is thicker than LEATHAC 66 having a ream weight of 175 kg was used. Combinations of the offset voltage (center voltage value) Voff and the peak-to-peak voltage Vpp that achieved the integrated evaluations Grade A or Grade B on both LEATHAC 66 having a ream weight of 175 kg and LEATHAC 66 having a ream weight of 215 kg were extracted from the above-described combinations of the offset voltage Voff and the peak-to-peak voltage Vpp. As a result, there was no combination that achieved Grade A on both types of sheets. The combination that obtained Grade B on both types of sheets was a combination of the peak-to-peak voltage Vpp of 6 kV and the offset voltage Voff of −1100±100 V (median=±9%).

Experiment 5

In an experiment 5, as the secondary transfer power source 39, a power source that outputs an offset voltage (center voltage value) Voff subjected to constant current control was employed. The target value of the output (offset current Ioff) was set in a range of from −30 μA to −60 μA. Except the conditions described above, the same conditions in the experiment 4 were employed in the experiment 5.

As a result, the combination of the peak-to-peak voltage Vpp and the offset current Ipp that achieved Grade A or above in the image density evaluation was a combination of the peak-to-peak voltage Vpp of 7 kV and the offset current Ioff of −42.5±7.5 μA (median±18%). The combination that achieved Grade B on both types of sheets was a combination of the peak-to-peak voltage Vpp of 7 kV and the offset current Ioff of −47.5±12.5 μA (median=±26%).

As described above, in the experiment 4, there was no combination that achieved Grade A on both types of sheets. By contrast, in the experiment 5, there was a combination that was able to achieve Grade A on both types of sheets. Furthermore, as for the combination that achieved Grade B, the offset voltage Voff was −1100±100 V (median±9%) in the experiment 4; whereas, in the experiment 5, the peak-to-peak voltage Vpp was 7 kV and the offset current Ioff was −47.5 μA±12.5 μA (median±26%).

It is obvious that the latter has a wider range from the midpoint value. These results of the experiments indicate that as compared with controlling the DC component under constant voltage control, controlling the DC component under constant current control can provide a wider range of control target value that can accommodate different thicknesses of recording media sheets.

In view of the above, according to the illustrative embodiments of the present disclosure, the power source 39 for the secondary transfer is configured to output a DC component under constant current control. Furthermore, as for the AC component, the power source 39 outputs a peak-to-peak voltage under constant voltage control. With this configuration, the peak-to-peak voltage Vpp is constant regardless of environmental changes. Therefore, an effective returning peak current and a transfer peak current can be generated reliably.

The above-described image forming apparatus is an example. The present disclosure includes the following embodiments. According to an aspect of this disclosure, an image forming apparatus includes a rotatable image bearing member (e.g., the intermediate transfer belt 31) to bear a toner image on a surface thereof; a nip forming member (e.g., the nip forming roller 36) to contact the surface of the image bearing member to form a transfer nip (e.g., the secondary transfer nip N) therebetween; and a power source (e.g., the power source 39) to apply a transfer bias to the transfer nip to transfer the toner image from the image bearing member onto a recording medium interposed in the transfer nip, the transfer bias including a superimposed transfer bias in which an alternating current (AC) component is superimposed on a direct current (DC) component and the polarity of the superimposed transfer bias changes with time. A phase difference between an AC voltage and an AC current output from the power source 39 is equal to or less than 0.47 cycles.

With this configuration, generation of white spots is suppressed without reducing a peak-to-peak voltage of the AC voltage.

According to an aspect of this disclosure, the phase difference is equal to or greater than 0.37 cycles.

Accordingly, as described above, degradation of the toner transferability at the recessed portions of the recording medium is prevented, and hence the pattern of light and dark patches associated with the surface conditions of the recording medium is prevented.

According to an aspect of this disclosure, the phase difference is always equal to or greater than 0.37 cycles and equal to or less than 0.47 cycles in an image forming operation within a given specification of the image forming apparatus.

With this configuration, as long as the image forming operation is within the given specification of the image forming apparatus, generation of the white spots and pattern of light and dark patches are suppressed, if not prevented entirely.

According to an aspect of this disclosure, an entire resistance of load (e.g., the secondary transfer nip N) to which the AC voltage and the AC current are input by the power source 39 is in a range of from $1.0\times10^{6}\Omega$ to $5.0\times10^{8}\Omega$.

This configuration facilitates adjustment of the phase difference between the AC voltage and the AC current output from the power source 39 to be in the specified range described above.

According to an aspect of this disclosure, a time-averaged value (Vave) of the AC voltage output from the power source 39 has a polarity in a transfer direction in which the toner is transferred from the image bearing member to the recording medium, and an absolute value of the time-averaged value (Vave) is greater than a midpoint value (Voff) of the voltage intermediate between a maximum value and a minimum value of the voltage.

With this configuration, when compared with using the superimposed transfer bias in which the time-averaged value Vave has the same value as the offset voltage Voff, good toner transferability is achieved during the image forming operation even when using a recording medium having a rough surface.

According to an aspect of this disclosure, the power source 39 outputs the AC voltage such that the duration of application of a voltage having a polarity opposite a polarity in the transfer direction in which the toner image is transferred from the image bearing member to the recording medium is equal to or greater than 0.03 msec.

As shown in FIG. 19 which shows the results of the experiment 2, when the frequency exceeds 15000 Hz, IDmax at the recessed portions drops rapidly. The reason is assumed that because the returning time is too short, there is not enough back-and-forth movement of the toner. In this case, the returning time is 0.033 msec when the frequency f is 15000 Hz. Therefore, when the voltage having the polarity opposite the polarity in the transfer direction in the secondary transfer voltage is equal to or greater than 0.03 msec, good toner transferability is achieved.

According to an aspect of this disclosure, the power source 39 outputs the AC voltage to satisfy the following relation: $f>(4/d)\times v$, where f is a frequency (Hz) of the AC voltage, d is a width (mm) of the transfer nip in a direction of rotation of the image bearing member, and v is a speed of rotation v (mm/s) of the image bearing member.

With this configuration, pitch unevenness is prevented.

According to an aspect of this disclosure, the power source 39 outputs the AC current and the AC voltage obtained by superimposing the AC component on the DC component subjected to constant current control.

With this configuration, a control target value has a large degree of allowance, thereby accommodating a variety of types of paper.

According to an aspect of this disclosure, the image forming apparatus includes an information receiving device to receive information on a speed of movement of the image bearing member, and a changing device to change a target current value employed in the constant current control based on the information received by the information receiving device.

With this configuration, the constant current control is properly performed in accordance with the speed of movement of the image bearing member.

According to an aspect of this disclosure, the present invention is employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Each of the functions of the described embodiments may be implemented by one or more processing circuits. A processing circuit includes a programmed processor, as a processor includes a circuitry. A processing circuit also includes devices such as an application specific integrated circuit (ASIC) and conventional circuit components arranged to perform the recited functions.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

a rotatable image bearing member to bear a toner image on a surface thereof and rotate;

a nip forming member to contact the surface of the image bearing member to form a transfer nip therebetween; and a power source to apply a transfer bias to the transfer nip to transfer the toner image from the image bearing member onto a recording medium interposed in the transfer nip, the transfer bias including a superimposed transfer bias in which an alternating current (AC) component is superimposed on a direct current (DC) component and a polarity of the superimposed transfer bias changes with time, wherein a phase difference between an AC voltage and an AC current output from the power source is equal to or less than 0.47 cycles when the superimposed transfer bias is output to the transfer nip in which the recording medium is interposed.

2. The image forming apparatus according to claim 1, wherein the phase difference is equal to or greater than 0.37 cycles.

3. The image forming apparatus according to claim 1, wherein the phase difference is always in a range of from 0.37 cycles and 0.47 cycles in an image forming operation within a given specification of the image forming apparatus.

4. The image forming apparatus according to claim 1, wherein an entire resistance of load to which the AC voltage and the AC current are input by the power source is in a range of from $1.0\times10^6\Omega$ to $5.0\times10^8\Omega$.

5. The image forming apparatus according to claim 1, wherein a time-averaged value (Vave) of the AC voltage output from the power source has a polarity in a transfer direction in which the toner is transferred from the image bearing member to the recording medium, and the time-averaged value (Vave) is at the transfer direction side relative to a midpoint value (Voff) of an output voltage intermediate between a maximum value and a minimum value of the voltage.

6. The image forming apparatus according to claim 1, wherein the power source outputs the AC voltage such that a duration of application of a voltage having a polarity opposite a polarity in a transfer direction in which the toner image is transferred from the image bearing member to the recording medium is equal to or greater than 0.03 msec.

7. The image forming apparatus according to claim 1, wherein the power source outputs the AC voltage to satisfy the following relation:

$f>(4/d)\times v$, where f is a frequency in hertz (Hz) of the AC voltage, d is a width (mm) of the transfer nip in a direction of rotation of the image bearing member, and v is a speed of rotation v (mm/s) of the image bearing member.

8. The image forming apparatus according to claim 1, wherein the power source outputs the AC current and the AC voltage obtained by superimposing the AC component on the DC component subjected to constant current control.

9. The image forming apparatus according to claim 8, wherein the image forming apparatus includes an information receiving device to receive information on a speed of movement of the image bearing member, and a changing device to change a target current value employed in the constant current control based on the information received by the information receiving device.

10. The image forming apparatus according to claim 1, wherein the phase difference between the AC voltage and the AC current output from the power source is equal to or less than 0.44 cycles.

11. The image forming apparatus according to claim 1, wherein the phase difference between the AC voltage and the AC current output from the power source is equal to or greater than 0.38 cycles.

12. The image forming apparatus according to claim 1, further comprising:

a back surface member that supports the image bearing member at the transfer nip, wherein one of the nip forming member and the back surface member is connected to the power source, and the other of the nip forming member and the back surface member is grounded.

13. The image forming apparatus according to claim 12, wherein the image bearing member is a transfer belt.

14. An image forming apparatus, comprising:

a rotatable image bearing member to bear a toner image on a surface thereof and rotate;

a nip forming member to contact the surface of the image bearing member to form a transfer nip therebetween; and a power source to apply a transfer bias to the transfer nip to transfer the toner image from the image bearing member onto a recording medium interposed in the transfer nip, the transfer bias including a superimposed transfer bias in which an alternating current (AC) component is superimposed on a direct current (DC) component and a polarity of the superimposed transfer bias changes with time, wherein a phase difference between an AC voltage and an AC current output from the power source is equal to or less than 0.47 cycles, and wherein an entire resistance of load to which the AC voltage and the AC current are input by the power source is in a range of from $1.0\times10^6\Omega$ to $5.0\times10^8\Omega$.

15. The image forming apparatus according to claim 14, wherein the phase difference is equal to or greater than 0.37 cycles.

16. The image forming apparatus according to claim 14, wherein the phase difference is always in a range of from 0.37 cycles and 0.47 cycles in an image forming operation within a given specification of the image forming apparatus.

17. The image forming apparatus according to claim 14, wherein a time-averaged value (Vave) of the AC voltage output from the power source has a polarity in a transfer direction in which the toner is transferred from the image bearing member to the recording medium, and the time-averaged value (Vave) is at the transfer direction side relative to a midpoint value (Voff) of an output voltage intermediate between a maximum value and a minimum value of the voltage.

18. The image forming apparatus according to claim 14, wherein the power source outputs the AC voltage such that a duration of application of a voltage having a polarity opposite a polarity in a transfer direction in which the toner image is transferred from the image bearing member to the recording medium is equal to or greater than 0.03 msec.

19. The image forming apparatus according to claim 14, wherein the power source outputs the AC voltage to satisfy the following relation:

$f>(4/d)\times v$, where f is a frequency in hertz (Hz) of the AC voltage, d is a width (mm) of the transfer nip in a direction of rotation of the image bearing member, and v is a speed of rotation v (mm/s) of the image bearing member.

20. The image forming apparatus according to claim 14, wherein the power source outputs the AC current and the AC voltage obtained by superimposing the AC component on the DC component subjected to constant current control.

21. The image forming apparatus according to claim 20, wherein the image forming apparatus includes an information receiving device to receive information on a speed of movement of the image bearing member, and a changing device to change a target current value employed in the constant current control based on the information received by the information receiving device.

* * * * *